US010096274B2

(12) United States Patent
Jung et al.

(10) Patent No.: US 10,096,274 B2
(45) Date of Patent: Oct. 9, 2018

(54) DATA DRIVER FOR REDUCING DATA TRANSMISSION, DISPLAY DEVICE, AND DATA DRIVING METHOD

(71) Applicant: LG DISPLAY CO., LTD., Seoul (KR)

(72) Inventors: TaeYoung Jung, Daegu (KR); JoungTae Kim, Goyang-si (KR); ChangKun Kim, Suwon-si (KR)

(73) Assignee: LG DISPLAY CO., LTD., Seoul (KR)

( * ) Notice: Subject to any disclaimer, the term of this patent is extended or adjusted under 35 U.S.C. 154(b) by 126 days.

(21) Appl. No.: 15/167,726

(22) Filed: May 27, 2016

(65) Prior Publication Data

US 2016/0351090 A1 Dec. 1, 2016

(30) Foreign Application Priority Data

May 29, 2015 (KR) ..... 10-2015-0076711

(51) Int. Cl.
*G09G 3/00* (2006.01)
*G09G 3/20* (2006.01)

(52) U.S. Cl.
CPC ..... *G09G 3/20* (2013.01); *G09G 3/2007* (2013.01); *G09G 3/2051* (2013.01); *G09G 2310/027* (2013.01); *G09G 2350/00* (2013.01)

(58) Field of Classification Search
CPC ..... G09G 3/20; G09G 3/2007; G09G 3/2051; G09G 2310/027; G09G 2350/00
See application file for complete search history.

(56) References Cited

U.S. PATENT DOCUMENTS 6,154,121 A * 11/2000 Cairns ..... H03M 1/664 341/118
6,970,121 B1 * 11/2005 Sun ..... G09G 3/3688 341/144
2007/0001885 A1 * 1/2007 Yen ..... H03M 1/68 341/144
2010/0164775 A1 * 7/2010 Kim ..... H03M 1/68 341/143

FOREIGN PATENT DOCUMENTS

KR 10-2007-0028007 A 3/2007

* cited by examiner

*Primary Examiner* — Kwang-Su Yang
(74) *Attorney, Agent, or Firm* — Birch, Stewart, Kolasch & Birch, LLP

(57) ABSTRACT

Provided is a data driver, a driving method of the data driver, and a display device. The data driver includes a latch unit configured to store n-bit image data, wherein n≥2; a conversion unit configured to convert N-bit digital data including the n-bit image data and variable m-bit pseudo control data into an analog voltage and then output the analog voltage, wherein m≥1; and an output unit configured to output a data voltage based on the analog voltage. The data driver is capable of supplying a high image quality based on N-bit digital data with a small circuit size that is based on n-bit image data.

10 Claims, 20 Drawing Sheets

| 10-BIT GRAY LEVEL | UPPER 8-BIT (12B) | LOWER 2-BIT |
|---|---|---|
| 512 | 1 0 0 0 0 0 0 0 | 0 0 |
| 513 | 1 0 0 0 0 0 0 0 | 0 1 |
| 514 | 1 0 0 0 0 0 0 0 | 1 0 |
| 515 | 1 0 0 0 0 0 0 0 | 1 1 |

DATA DRIVER FOR REDUCING DATA TRANSMISSION, DISPLAY DEVICE, AND DATA DRIVING METHOD

CROSS-REFERENCE TO RELATED APPLICATIONS

This application claims priority from Korean Patent Application No. 10-2015-0076711 filed on May 29, 2015, which is hereby incorporated by reference for all purposes as if fully set forth herein.

BACKGROUND OF THE INVENTION

Field of the Invention

The embodiments of the invention relate to a data driver, a display device, and a data driving method.

Description of the Related Art

With the development of the information society, various demands for display devices for displaying images have been increasing. In recent years, various display devices such as a liquid crystal display device, a plasma display panel, and an organic light emitting display device are being used.

Such a display device includes a display panel in which data lines and gate lines are formed and sub-pixels are defined at intersections between the data lines and the gate lines. The display device further includes a data driver configured to supply a data voltage to the data lines, a gate driver configured to supply a scan signal to the gate lines, and a timing controller configured to control the data driver and the gate driver.

In the display device, the data driver receives image data formed of predetermined bits from the timing controller, converts the received image data to a data voltage corresponding to an analog voltage, and supplies the data voltage to a sub-pixel corresponding thereto.

Herein, if the number of bits in the image data is increased, color depth (expression) expressed in the corresponding sub-pixel is increased. Thus, an image quality can be improved.

In order to realize a high-quality color depth, i.e., in order to realize color depth with a high bit number, the number of bits which can be processed by the internal components of the data driver needs to be equivalent to the bit number corresponding to the desired color depth.

Therefore, in order to realize an excellent color depth, sizes of the internal components in the data driver are necessarily increased. Thus, a size of the data driver is necessarily increased.

Further, the data driver needs to receive image data with a bit number corresponding to the desired color depth from the timing controller. Therefore, there is a problem in that a data transmission amount between the timing controller and the data driver is necessarily increased.

SUMMARY OF THE INVENTION

An aspect of the present invention provides a data driver and a driving method of the data driver capable of supplying a high image quality with a small size.

Another aspect of the present invention provides a data driver, a display device, and a data driving method capable of supplying a high image quality and reducing a data transmission amount.

Yet another aspect of the present invention provides a data driver, a display device, and a data driving method capable of realizing color depth of N-bit having a higher bit number than n-bit using n-bit image data.

Still another aspect of the present invention provides a data driver, a display device, and a data driving method capable of realizing color depth of N-bit having a higher bit number than n-bit using n-bit image data while supplying an excellent image quality.

Still another aspect of the present invention provides a data driver capable of realizing desired N-bit color depth with a small size.

According to an aspect of the present invention, there is provided a data driver including: a latch unit configured to store n-bit image data ($n \geq 2$); a conversion unit configured to convert N-bit digital data (e.g.: $N=n+m$) including the n-bit image data and variable m-bit pseudo control data ($m \geq 1$) into an analog voltage and then output the analog voltage; and an output unit configured to output a data voltage on the basis of the analog voltage.

According to another aspect of the present invention, there is provided a display device including: a display panel in which a plurality of data lines and a plurality of gate lines are disposed; a timing controller configured to receive input image data of higher than n-bit ($n \geq 2$) and output n-bit image data; and a data driver configured to receive the n-bit image data and output a data voltage to the plurality of data lines.

In the display device, the data driver may convert N-bit digital data including the n-bit image data and variable m-bit pseudo control data ($m \geq 1$) into an analog voltage and then output the data voltage on the basis of the analog voltage.

According to yet another aspect of the present invention, there is provided a data driving method of a data driver, including: storing n-bit image data ($n \geq 2$); converting N-bit digital data (e.g.: $N=n+m$) including the n-bit image data and variable m-bit pseudo control data ($m \geq 1$) into an analog voltage; and outputting a data voltage on the basis of the analog voltage.

According to the present aspects described above, it is possible to provide a data driver and a driving method of the data driver capable of supplying a high image quality with a small size.

According to the present aspects, it is possible to provide a data driver, a display device, and a data driving method capable of supplying a high image quality and reducing a data transmission amount.

According to the present aspects, it is possible to provide a data driver, a display device, and a data driving method capable of realizing color depth of N-bit having a higher bit number than n-bit using n-bit image data.

According to the present aspects, it is possible to provide a data driver, a display device, and a data driving method capable of realizing color depth of N-bit having a higher bit number than n-bit using n-bit image data while supplying an excellent image quality.

According to the present aspects, it is possible to provide a data driver capable of realizing desired N-bit color depth with a small size.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE INVENTION

Figure 1:
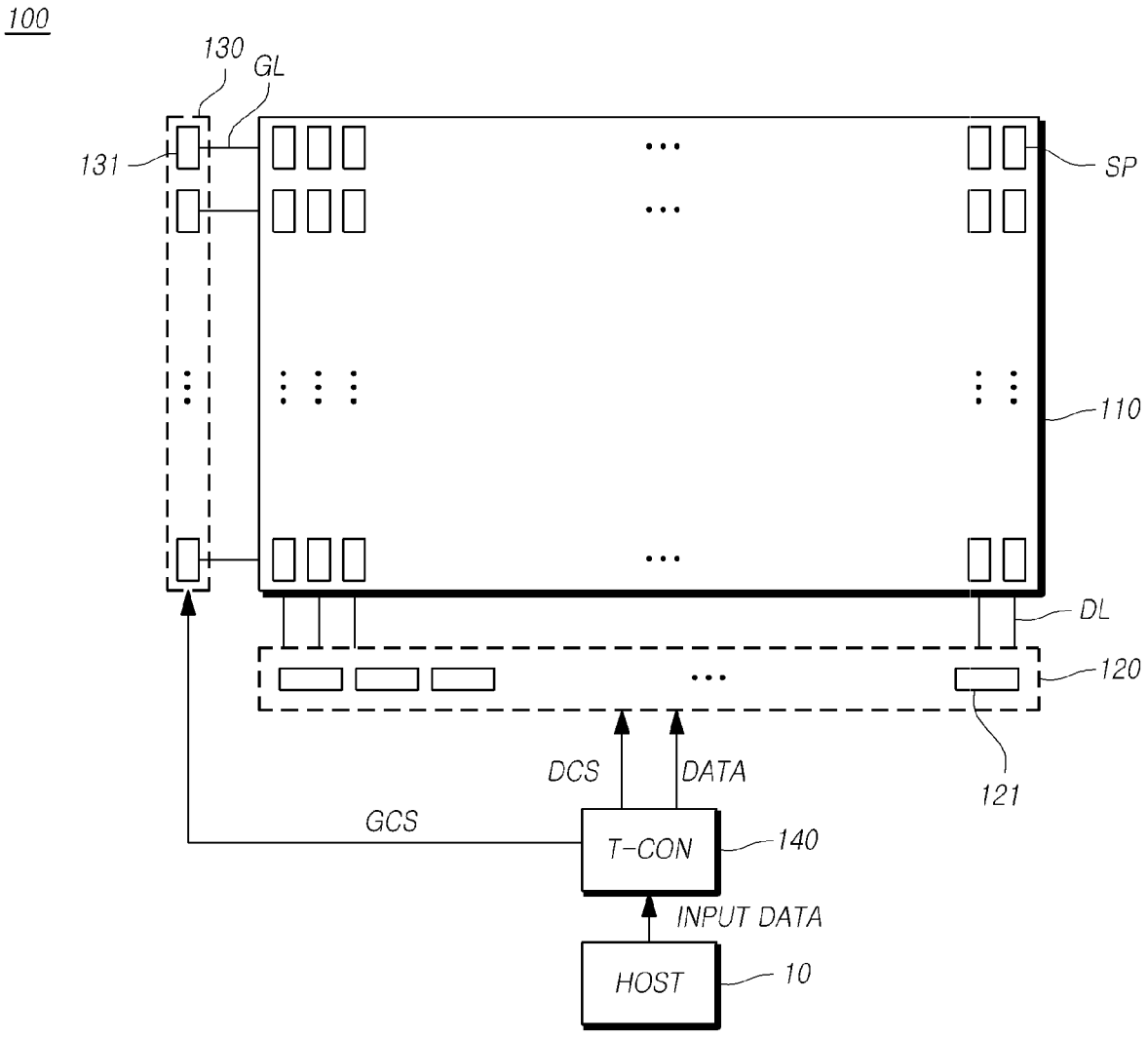
FIG. 1 is a schematic system configuration view of a display device according to an embodiment of the present invention.

Hereinafter, some example embodiments of the present invention will be described in detail with reference to the accompanying drawings. In adding reference numerals to components throughout the drawings, like reference numerals may designate like components even though components are shown in different drawings.

Further, in describing components of the present invention, terms such as first, second, A, B, (a), (b), etc. can be used. These terms are used only to differentiate the components from other components. Therefore, the nature, order, sequence, or number of the corresponding components is not limited by these terms. It is to be understood that when one element is referred to as being "connected to" or "coupled to" another element, it may be directly connected to or directly coupled to another element, connected to or coupled to another element, having still another element "intervening" therebetween, or "connected to" or "coupled to" another element via still another element.

FIG. 1 is a schematic system configuration view of a display device 100 according to an embodiment of the present invention.

Referring to FIG. 1, the display device 100 according to an embodiment of the present invention includes a display panel 110 in which a plurality of data lines DL and a plurality of gate lines GL are disposed and a plurality of sub-pixels SP is disposed in a matrix, a data driver 120 configured to drive the plurality of data lines DL by supplying a data voltage to the plurality of data lines DL, a gate driver 130 configured to sequentially drive the plurality of gate lines GL by sequentially supplying a scan signal to the plurality of gate lines GL, and a timing controller (T-CON) 140 configured to control the data driver 120 and the gate driver 130.

The timing controller 140 controls the data driver 120 and the gate driver 130 by supplying various controls signals DCS and GCS to the data driver 120 and the gate driver 130.

The timing controller 140 starts a scan according to timing implemented in each frame, converts image data input from the outside in correspondence to a data signal form used by the data driver 120, outputs the converted image data DATA, and controls a driving of data at a proper time according to the scan.

The gate driver 130 sequentially supplies a scan signal of an on or off voltage to the plurality of gate lines GL according to the control of the timing controller 140 to sequentially drive the plurality of gate lines GL.

The gate driver 130 may be positioned on only one side of the display panel 110 as illustrated in FIG. 1, or may be positioned on both sides of the display panel 110, depending on a driving method of the gate driver 130.

Further, the gate driver 130 may include one or more gate driver integrated circuits 131.

The one or more gate driver integrated circuits 131 may be connected to a bonding pad of the display panel 110 through a Tape Automated Bonding (TAB) method or a Chip On Glass (COG) method, or implemented in a Gate In Panel (GIP) type and directly disposed in the display panel 110, or integrated and disposed in the display panel 100.

Each gate driver integrated circuit 131 may include a shift register, a level shifter, and other circuitry.

When a specific gate line is opened, the data driver 120 converts image data DATA received from the timing controller 140 into a data voltage of an analog form and supplies the data voltage to the plurality of data lines DL to drive the plurality of data lines DL.

The data driver 120 may include at least one source driver integrated circuit (SD-IC) 121 to drive the plurality of data lines DL.

The source driver integrated circuits 121 may be connected to a bonding pad of the display panel 110 through a Tape Automated Bonding (TAB) method or a Chip On Glass (COG) method, or directly disposed in the display panel 110, or integrated and disposed in the display panel 100 if necessary.

Each source driver integrated circuit 121 may be implemented in a Chip On Film (COF) type.

In this case, one end of each source driver integrated circuit 121 is bonded to at least one source printed circuit board and the other end thereof is bonded to the display panel 110.

Each source driver integrated circuit 121 may include a shift register, a logic unit including a latch circuit, a digital-analog converter DAC, an output buffer, and other circuitry.

Meanwhile, the timing controller 140 receives input image data INPUT DATA together with various timing signals, such as a vertical synchronization signal Vsync, a horizontal synchronization signal Hsync, an input data enable (DE) signal, a clock signal CLK, etc., from an external host system 10.

The timing controller 140 converts the input image data INPUT DATA input from the host system 10 in correspondence to a data signal form used by the data driver 120 and outputs the converted image data DATA. Further, the timing controller 140 receives timing signals, such as a vertical synchronization signal Vsync, a horizontal synchronization signal Hsync, an input DE signal, a clock signal, etc., generates various control signals (DCS and GCS), and outputs the control signals to the data driver 120 and the gate driver 130 in order to control the data driver 120 and the gate driver 130.

For example, the timing controller 140 outputs various gate control signals (GCS) including a gate start pulse (GSP), a gate shift clock (GSC), a gate output enable (GOE) signal, etc. in order to control the gate driver 130.

Herein, the gate start pulse (GSP) controls an operation start timing of the one or more gate driver integrated circuits constituting the gate driver 130. The gate shift clock (GSC) is a clock signal commonly input to the one or more gate driver integrated circuits, and controls a shift timing of a scan signal (gate pulse). The gate output enable (GOE) signal designates timing information of the one or more gate driver integrated circuits.

Further, the timing controller 140 outputs various data control signals (DCS) including a source start pulse (SSP), a source sampling clock (SSC), a source output enable (SOE) signal, etc. in order to control the data driver 120.

Herein, the source start pulse (SSP) controls a data sampling start timing of the one or more source driver integrated circuits constituting the data driver 120. The source sampling clock (SSC) is a clock signal for controlling a data sampling timing in each source driver integrated circuit. The source output enable (SOE) signal controls an output timing of the data driver 120.

Referring to FIG. 1, the timing controller 140 may be disposed in a control printed circuit board connected through a connection medium, such as a flexible flat cable (FFC) or a flexible printed circuit (FPC), to the source printed circuit board to which the source driver integrated circuits 121 are bonded.

In the control printed circuit board, a power controller configured to supply various voltages or currents to the display panel 110, the data driver 120, and the gate driver 130 or control various voltages or currents to be supplied thereto may be further disposed. The power controller may also be referred to as a power management IC (PMIC).

The above-described source printed circuit board and control printed circuit board may be formed into a single printed circuit board.

In each of the plurality of sub-pixels disposed in the display panel 110 according to an embodiment of the present invention, circuit elements such as a transistor and a capacitor may be disposed.

Figure 2:
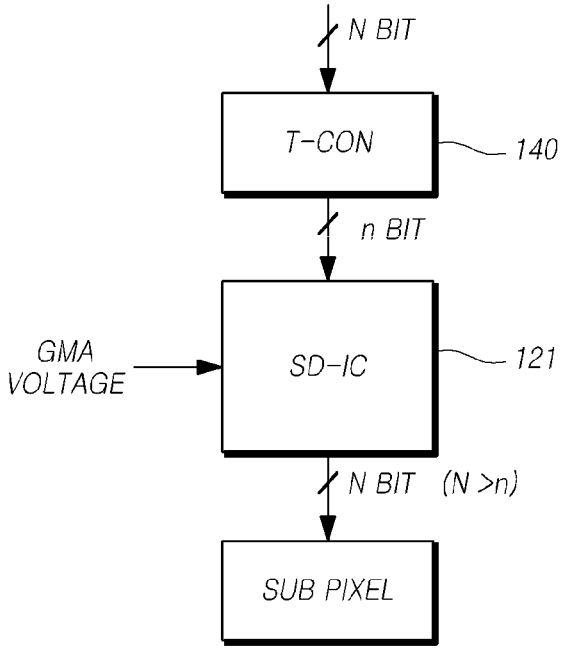
FIG. 2 is a diagram provided to explain N-bit color depth (N=n+m) of a display device according to an embodiment of the present invention.

FIG. 2 is a diagram provided to explain N-bit color depth (N=n+m) of the display device 100 according to an embodiment of the present invention.

Referring to FIG. 2, the display device 100 according to an embodiment of the present invention may supply N-bit (e.g., 10-bit, 12-bit) color depth.

Herein, the term "color depth" may be referred to as color expression or resolution, brightness expression, or gray level expression.

Referring to FIG. 2, in the display device 100 according to an embodiment of the present invention, the host system 10 outputs N-bit input image data INPUT DATA corresponding to each sub-pixel SP to the timing controller 140, where N is a positive integer.

Referring to FIG. 2, the timing controller 140 receives the N-bit input image data INPUT DATA corresponding to the sub-pixel SP and outputs n-bit image data DATA ($n \geq 2$, where n is a positive integer) corresponding to the sub-pixel SP to the source driver integrated circuit 121 corresponding thereto. Herein, N-bit has a higher value than n-bit (N>n).

The source driver integrated circuit 121 receives the n-bit image data DATA corresponding to the sub-pixel SP, performs digital-analog conversion, and outputs a data voltage V data having N-bit color depth (N>n) to a channel (data line) corresponding to the sub-pixel SP.

Referring to FIG. 2, in order for the display device 100 according to an embodiment of the present invention to supply N-bit color depth (N=n+m, where m is a positive integer), each source driver integrated circuit 121 in the data driver 120 receives n-bit image data DATA corresponding to each sub-pixel SP, converts N-bit digital data ($N=m+n$, $N \geq 3$) including the received n-bit image data and additional m-bit data (hereinafter, referred to as "pseudo control data PC") ($m \geq 1$) into an analog voltage on the basis of a gamma voltage GMA Voltage, and outputs a data voltage V data having N-bit color depth on the basis of the analog voltage.

As described above, the source driver integrated circuit 121 receives image data DATA of n-bit having a lower value than N-bit image data DATA and supplies N-bit color depth. Thus, it is possible to realize N-bit color depth with a reduced size of the source driver integrated circuit 121.

Herein, in order to realize N-bit color depth (N=n+m), the pseudo control data PC as the additional m-bit data added to the n-bit image data DATA may be a bit stream fixed all the time, or may be a bit stream variable according to a certain rule, which will be described more fully below.

Meanwhile, each source driver integrated circuit 121 includes at least one channel. Each channel corresponds to any one data line and can be regarded as corresponding to any one sub-pixel included in a sub-pixel column connected to the data line.

Figure 3:
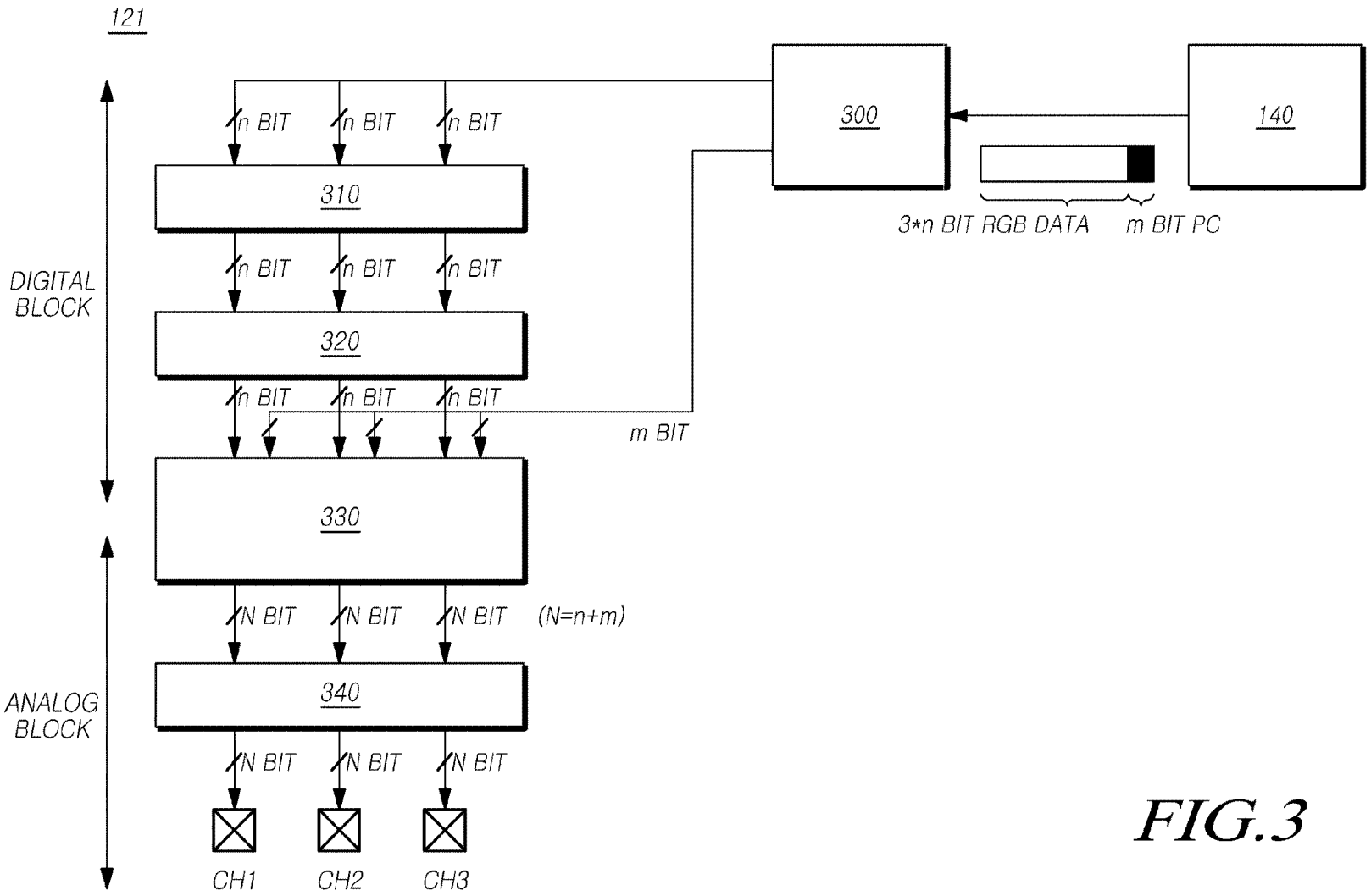
FIG. 3 is a schematic block diagram of a source driver integrated circuit for realizing N-bit color depth according to an embodiment of the present invention.

The above-described operation is performed in each channel of each source driver integrated circuit 120 as illustrated in FIG. 3.

Figure 4:
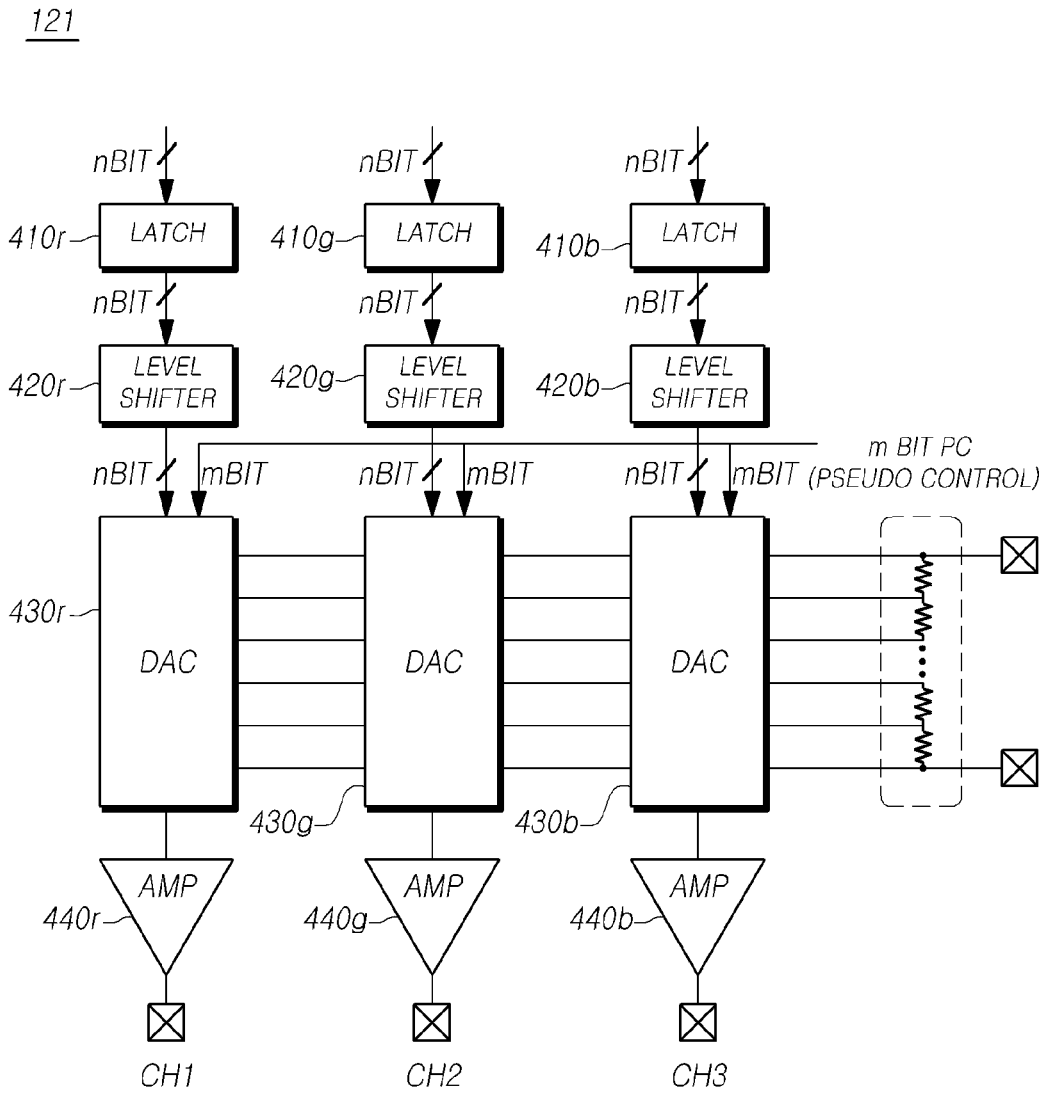
FIG. 4 is a block diagram of a source driver integrated circuit for realizing N-bit color depth according to an embodiment of the present invention.

FIG. 3 is a schematic block diagram of the source driver integrated circuit 121 for realizing N-bit color depth according to an embodiment of the present invention. FIG. 4 is a detailed block diagram of the source driver integrated circuit 121 for realizing N-bit color depth according to an embodiment of the present invention.

In FIG. 3, it is assumed that each source driver integrated circuit 121 includes three channels CH1, CH2, and CH3. Herein, CH1 is a channel configured to supply a data voltage to a red sub-pixel and connected to the red sub-pixel and a data line for supplying a data voltage. CH2 is a channel configured to supply a data voltage to a green sub-pixel and connected to the green sub-pixel and a data line for supplying a data voltage. CH3 is a channel configured to supply a data voltage to a blue sub-pixel and connected to the blue sub-pixel and a data line for supplying a data voltage. The driver integrated circuit is not limited to three channels. For example, a fourth channel may be included for yellow. Other channels may be included for black and white. Also, other color gamuts are possible. For example, a CMYK color gamut may be used, and include channels for cyan, magenta, yellow and black.

Referring to FIG. 3, in the display device 100 according to an embodiment of the present invention, the timing controller 140 extracts n-bit image data DATA from input image data INPUT DATA of higher than n-bit, i.e., N-bit input image data INPUT DATA in order to realize N-bit color depth.

Accordingly, in order to compensate image data deficient as much as N−n (=m)-bit, the timing controller 140 may generate m-bit pseudo control data PC on the basis of input image data (i.e., m (=N−n)-bit input image data) remaining after extracting the n-bit image data from the input image data INPUT DATA of higher than n-bit, i.e., N-bit input image data INPUT DATA.

Otherwise, the timing controller 140 may generate m-bit pseudo control data PC on the basis of frame information corresponding to the input image data INPUT DATA of higher than n-bit, i.e., N-bit input image data INPUT DATA.

Alternatively, the timing controller 140 may generate m-bit pseudo control data PC on the basis of row line (identical to a sub-pixel row) information corresponding to the input image data INPUT DATA of higher than n-bit, i.e., N-bit input image data INPUT DATA.

The timing controller 140 may transmit n-bit image data DATA corresponding to the respective three channels CH1, CH2, and CH3 included in the source driver integrated circuit 121 with the m-bit pseudo control data PC to the source driver integrated circuit 121. In the present specification, the n-bit image data DATA corresponding to the respective three channels CH1, CH2, and CH3 may also be referred to as "RGB data (3*n-bit)".

Referring to FIG. 3, each source driver integrated circuit 121 within the data driver 120 according to an embodiment of the present invention may include a latch unit 310 configured to store n-bit image data for each channel, a conversion unit 330 configured to convert N-bit digital data (N=n+m) including the n-bit image data and the variable m-bit pseudo control data PC into an analog voltage and then output the analog voltage for each channel, and an output unit 340 configured to output a data voltage capable of driving the corresponding data line on the basis of the analog voltage for each channel.

Referring to FIG. 4, the latch unit 310 may include n-bit latches 410*r*, 410*g*, and 410*b* for the respective channels CH1, CH2, and CH3.

Further, the conversion unit 330 may include N(=n+m)-bit digital-analog converters 430*r*, 430*g*, and 430*b* for the respective channels CH1, CH2, and CH3.

Furthermore, the output unit 340 may include output buffers 440*r*, 440*g*, and 440*b* configured to output a data voltage for realizing N (=n+m)-bit color depth for the respective channels CH1, CH2, and CH3.

If the above-described source driver integrated circuit 121 is used, it is possible to supply N-bit color depth even with n-bit image data having a lower bit number than N-bit image data desired to be expressed.

Further, the above-described source driver integrated circuit 121 may be implemented with the n-bit latches 410*r*, 410*g*, and 410*b* rather than N-bit latches for the respective channels CH1, CH2, and CH3 in order to supply N-bit color depth. Therefore, a size of the source driver integrated circuit 121 can be reduced accordingly.

Meanwhile, referring to FIG. 3, each source driver integrated circuit 121 within the data driver 120 according to an embodiment of the present invention may further include a level shifting unit 320 configured to shift a voltage level between the latch unit 310 and the conversion unit 330.

The level shifting unit 320 may include n-bit levels shifters 420*r*, 420*g*, and 420*b* for the respective channels CH1, CH2, and CH3 as illustrated in FIG. 4.

The above-described source driver integrated circuit 121 may be implemented with the n-bit levels shifters 420*r*, 420*g*, and 420*b* rather than N-bit level shifters for the respective channels CH1, CH2, and CH3 in order to efficiently supply N-bit color depth. Therefore, a size of the source driver integrated circuit 121 can be further reduced accordingly.

Meanwhile, the above-described conversion unit 330 may convert m+n-bit digital data including m-bit pseudo control data PC added as least significant bits LSB of n-bit image data for each channel into an analog voltage.

As described above, the conversion unit 330 adds the m-bit pseudo control data PC as the least significant bits LSB to the n-bit image data and thus minimizes a difference between original N-bit input image data and N-bit digital data created for digital-analog conversion. Therefore, it is possible to more accurately express a color.

Meanwhile, when digital-analog conversion is performed for each channel, the conversion unit 330 performs digital-analog conversion to n+m-bit digital data in which m-bit pseudo control data PC are added to n-bit image data for each channel.

That is, the m-bit pseudo control data PC are added to the n-bit image data for each channel. Further, the m-bit pseudo control data PC added to the n-bit image data for each channel may be identical to each other.

The m-bit pseudo control data PC are transmitted from the timing controller 140 to the source driver integrated circuit 121.

As described above, the m-bit pseudo control data PC are identical to each other regardless of a channel and thus do not need to be transmitted to each channel.

Therefore, as illustrated in FIG. 4, the source driver integrated circuit 121 including the three channels CH1, CH2, and CH3 Receives 3*n-bit image data (RGB data) including n-bit image data for each of the three channels CH1, CH2, and CH3, but may receive a single m-bit pseudo control data PC which can be used in common for the three channels CHL CH2, and CH3.

In this case, a receiving unit 300 of the source driver integrated circuit 121 receives data including a data field RGB DATA Field including n-bit image data for each channel and a control field CTR Field including m-bit pseudo control data PC from the timing controller 140.

As described above, the source driver integrated circuit 121 receives m-bit pseudo control data PC which can be used in common for all channels regardless of the number of channels. That is, the timing controller 140 transmits m-bit pseudo control data PC which can be used in common for all channels. Therefore, a data transmission amount between the timing controller 140 and the source driver integrated circuit 121 can be greatly reduced.

As described above, the common m-bit pseudo control data PC is added to the n-bit image data for each channel. In such case, the accuracy in expressing a color may be limited.

Accordingly, the timing controller 140 generates an m-bit pseudo control data PC in order to accurately express a color.

For example, the timing controller 140 may generate an m-bit pseudo control data PC on the basis of at least one of N-bit input image data corresponding to each channel, n-bit image data for each channel, frame information about a frame related to the n-bit image data for each channel, and row line information about a row line (sub-pixel row) including a sub-pixel to which the n-bit image data for each channel is supplied.

Accordingly, the m-bit pseudo control data PC may be changed depending on the N-bit input image data (input image data of higher than n-bit including the n-bit image data) or the n-bit image data.

In this case, at the time of digital-analog conversion, the source driver integrated circuit 121 generates n+m-bit digital data (n-bit image data and m-bit pseudo control data) identical or very similar to the N-bit input image data and then performs digital-analog conversion. Therefore, it is possible to more accurately express a color.

Meanwhile, the m-bit pseudo control data PC may be changed whenever a frame is changed.

For example, the m-bit pseudo control data PC may be changed every $2^m$ frame cycle.

As an example, in the case of m=2, 2-bit pseudo control data PC is changed every 4-frame cycle as follows.

Pseudo control data PC for each frame in the case of m=2:

00 (PC of Frame 1)⇒01 (PC of Frame 2)⇒10 (PC of Frame 3)⇒11 (PC of Frame 4)⇒00 (PC of Frame 5)⇒01 (PC of Frame 6)⇒10 (PC of Frame 7)⇒11 (PC of Frame 8)⇒ . . . .

As described above, the m-bit pseudo control data PC are changed depending on a frame. Thus, the m-bit pseudo control data PC added to the n-bit image data for each channel suitably reflects screen characteristics (e.g., color characteristics, brightness characteristics, gray level characteristics, etc.) of the corresponding frame. Therefore, it is possible to supply a high-quality image while realizing N-bit color depth using image data of n-bit having a lower bit number than N-bit corresponding to a desired color depth.

Meanwhile, the m-bit pseudo control data PC may be changed whenever a row line is changed.

For example, the m-bit pseudo control data PC may be changed every $2^m$ row line cycle.

As a specific example, in the case of m=2, 2-bit pseudo control data PC may be changed every 4-row line cycle as follows.

Pseudo control data PC for each frame in the case of m=2:

00 (PC of Row Line 1)⇒01 (PC of Row Line 2)⇒10 (PC of Row Line 3)⇒11 (PC of Row Line 4)⇒00 (PC of Row Line 5)⇒01 (PC of Row Line 6)⇒10 (PC of Row Line 7)⇒11 (PC of Row Line 8)⇒ . . . .

As described above, the m-bit pseudo control data PC are changed depending on a row line. Thus, the m-bit pseudo control data PC added to the n-bit image data for each channel further suitably reflects screen characteristics (e.g., color characteristics, brightness characteristics, gray level characteristics, etc.) of the corresponding row line. Therefore, it is possible to supply a high-quality image while realizing N-bit color depth using image data of n-bit having a lower bit number than N-bit corresponding to the desired color depth.

Meanwhile, the source driver integrated circuit 121 itself, instead of the timing controller 140, can generate m-bit pseudo control data PC suitable for a predetermined sequence rule (PC information according to a frame sequence or PC information according to a row line sequence).

Meanwhile, the above-described methods may be simplified. In a simpler method, the m-bit pseudo control data PC may be randomly changed among all possible cases.

For example, in the case of m=2, all possible cases of 2-bit pseudo control data PC are four cases (00, 01, 10, and 11). When transmitting n-bit image data for each channel, the timing controller 140 may transmit one kind of 2-bit pseudo control data PC among the four cases (00, 01, 10, and 11).

In this case, the timing controller 140 can readily generate m-bit pseudo control data PC.

Meanwhile, the source driver integrated circuit 121 itself, instead of the timing controller 140, may generate m-bit pseudo control data PC suitable for a predetermined sequence rule.

Figure 5:
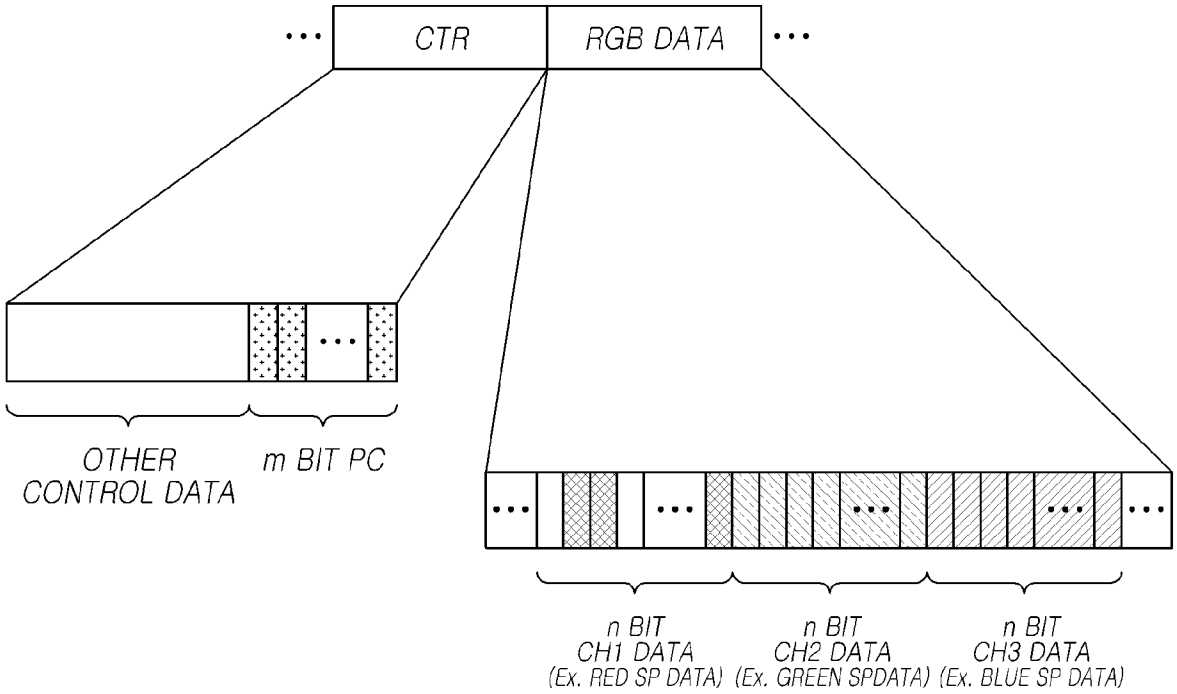
FIG. 5 is an exemplary diagram of a data format used for realizing N-bit color depth in a source driver integrated circuit according to an embodiment of the present invention and illustrates the data format including n-bit image data and m-bit pseudo control data for each channel.

FIG. 5 is an exemplary diagram of a data format used for realizing N-bit color depth in the source driver integrated circuit 121 according to an embodiment of the present invention and illustrates the data format including n-bit image data for each channel and m-bit pseudo control data PC.

In FIG. 5, data transmitted from the timing controller 140 to each source driver integrated circuit 121 includes a control field CTR, an RGB data field, etc.

Referring to FIG. 5, the RGB data field may include n-bit image data (e.g., red sub-pixel data) corresponding to CH1, n-bit image data (e.g., green sub-pixel data) corresponding to CH2, and n-bit image data (e.g., blue sub-pixel data) corresponding to CH3.

The RGB data field may include, for example, a unit interval (UI) bit corresponding to 4-bit.

Referring to FIG. 5, the control field CTR may include m-bit pseudo control data PC added in common to each of the n-bit image data (e.g., red sub-pixel data) corresponding to CH1, the n-bit image data (e.g., green sub-pixel data) corresponding to CH2, and the n-bit image data (e.g., blue sub-pixel data) corresponding to CH3.

That is, even if the RGB data field includes n-bit image data for each of the three channels CH1 CH2, and CH3, the control field CTR may include one m-bit pseudo control data PC.

Figure 6:
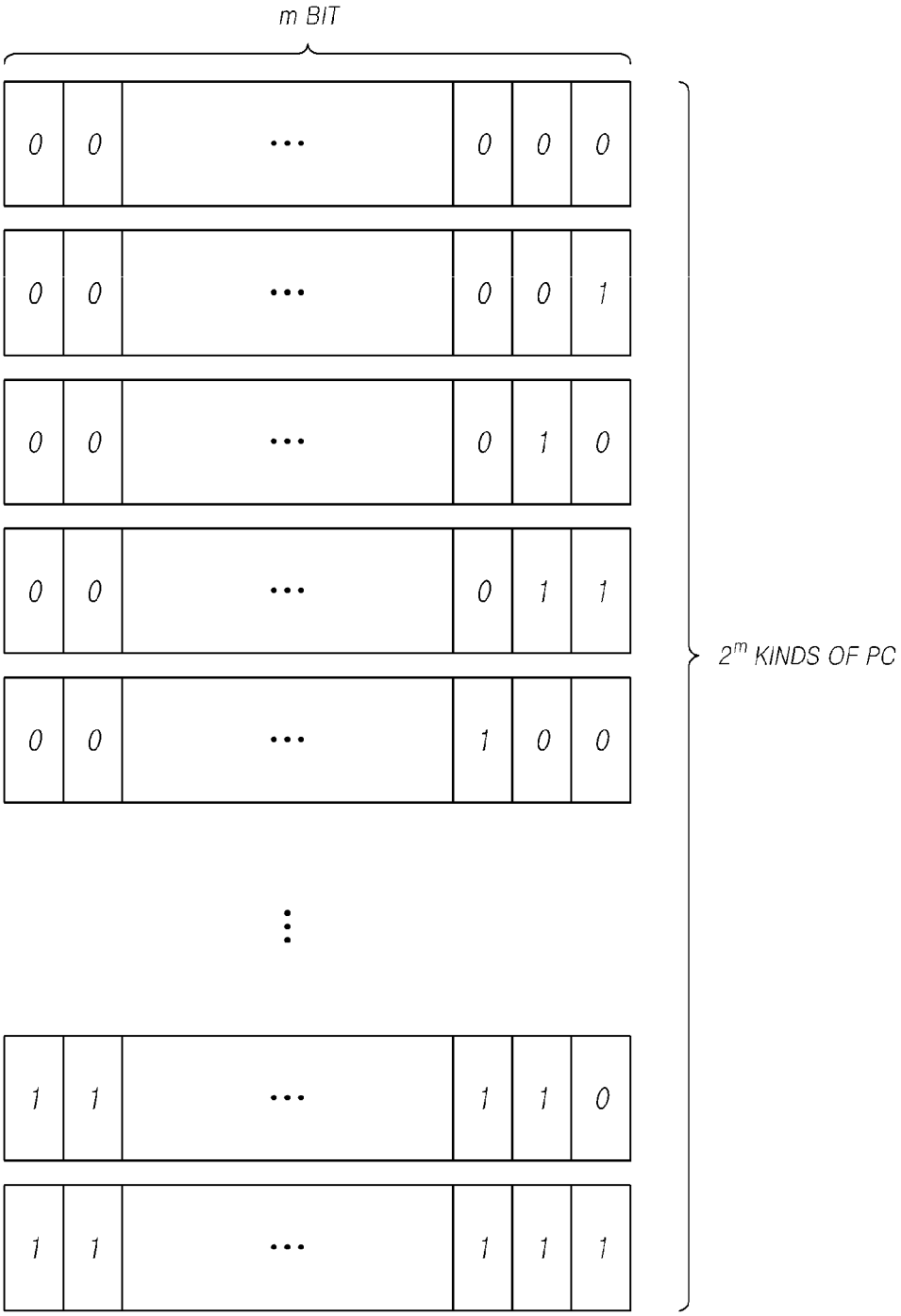
FIG. 6 is a diagram illustrating m-bit pseudo control data used for realizing N-bit color depth in a source driver integrated circuit according to an embodiment of the present invention.

FIG. 6 is a diagram illustrating m-bit pseudo control data PC used for realizing N-bit color depth in the source driver integrated circuit 121 according to an embodiment of the present invention.

Referring to FIG. 6, if pseudo control data PC are formed of m-bit, there are a total of $2^m$ possible cases of the pseudo control data PC.

Hereinafter, the source driver integrated circuit 121, a data format, and 2-bit pseudo control data PC in the case where N is 10, n is 8, and m is 2, i.e., where each source driver integrated circuit 121 within the date driver 120 receives 8-bit image data for each channel and 2-bit pseudo control data PC from the timing controller 140 and generates and outputs a data voltage capable of realizing 10-bit color depth in order to realize 10-bit color depth, will be described with reference to FIG. 7, FIG. 8, and FIG. 9, respectively.

Figure 7:
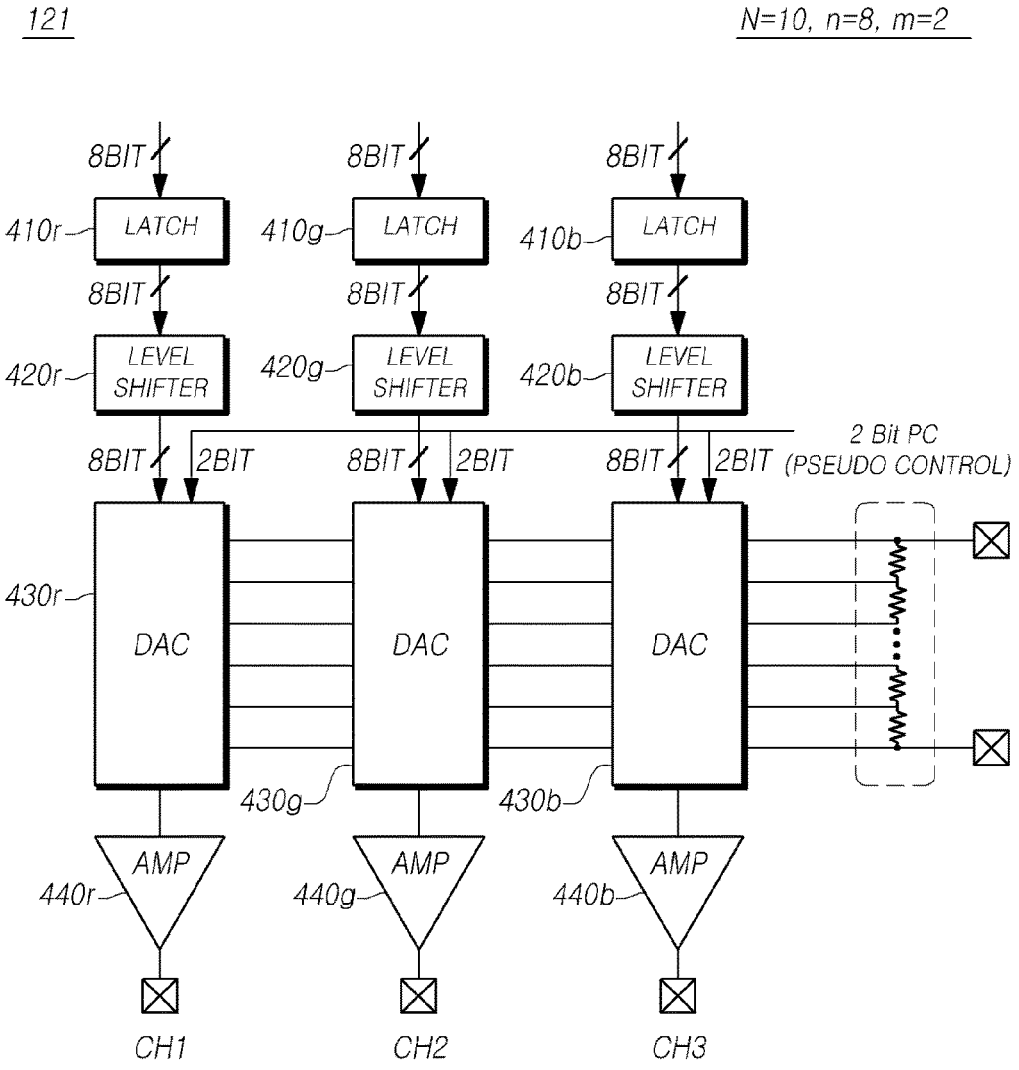
FIG. 7 is a block diagram of a source driver integrated circuit for realizing 10-bit color depth according to an embodiment of the present invention.

FIG. 7 is a block diagram of the source driver integrated circuit 121 for realizing 10-bit color depth according to an embodiment of the present invention. FIG. 8 is an exemplary diagram of a data format used for realizing 10-bit color depth in the source driver integrated circuit 121 according to an embodiment of the present invention and illustrates the data format including 8-bit image data and 2-bit pseudo control data PC for each channel. FIG. 9 is a diagram illustrating 2-bit pseudo control data PC used for realizing 10-bit color depth in the source driver integrated circuit 121 according to an embodiment of the present invention.

Referring to FIG. 7, each source driver integrated circuit 121 within the data driver 120 according to an embodiment of the present invention may include the latch unit 310 configured to store 8-bit image data for each channel, the conversion unit 330 configured to convert 10-bit digital data (10=2+8) including the 8-bit image data and the variable 2-bit pseudo control data PC into an analog voltage and then output the analog voltage for each channel, and the output unit 340 configured to output a data voltage on the basis of the analog voltage for each channel.

Referring to FIG. 7, the latch unit 310 may include the 8-bit latches 410*r*, 410*g*, and 410*b* for the respective channels CH1, CH2, and CH3.

Further, the conversion unit 330 may include the 10(=8+2)-bit digital-analog converters 430*r*, 430*g*, and 430*b* for the respective channels CH1, CH2, and CH3.

Furthermore, the output unit 340 may include the output buffers 440*r*, 440*g*, and 440*b* configured to output a data voltage for realizing 10(=8+2)-bit color depth for the respective channels CH1, CH2, and CH3.

If the above-described source driver integrated circuit 121 is used, it is possible to supply 10-bit color depth even with 8-bit image data having a lower bit number than 10-bit image data desired to be expressed.

Further, the above-described source driver integrated circuit 121 may be implemented with the 8-bit latches 410*r*, 410*g*, and 410*b* rather than 10-bit latches for the respective channels CH1, CH2, and CH3 in order to supply 10-bit color depth. Therefore, a size of the source driver integrated circuit 121 can be reduced accordingly.

Meanwhile, referring to FIG. 3, each source driver integrated circuit 121 within the data driver 120 according to an embodiment of the present invention may further include the level shifting unit 320 configured to shift a voltage level between the latch unit 310 and the conversion unit 330.

The level shifting unit 320 may include the 8-bit level shifters 420*r*, 420*g*, and 420*b* for the respective channels CH1, CH2, and CH3 as illustrated in FIG. 7.

The above-described source driver integrated circuit 121 may be implemented with the 8-bit level shifters 420*r*, 420*g*, and 420*b* rather than 10-bit level shifters for the respective channels CH1, CH2, and CH3 in order to efficiently supply 10-bit color depth. Therefore, a size of the source driver integrated circuit 121 can be further reduced accordingly.

Meanwhile, the above-described conversion unit 330 may convert 2+8-bit digital data including 2-bit pseudo control data PC added as least significant bits LSB of 8-bit image data for each channel into an analog voltage.

As described above, the conversion unit 330 adds the 2-bit pseudo control data PC as the least significant bits LSB to the 8-bit image data and thus minimizes a difference between original 10-bit input image data and 10-bit digital data created for digital-analog conversion. Therefore, it is possible to more accurately express a color.

Meanwhile, when digital-analog conversion is performed for each channel, the conversion unit 330 performs digital-analog conversion to 8+2-bit digital data in which 2-bit pseudo control data PC are added to 8-bit image data for each channel.

That is, the 2-bit pseudo control data PC are added to the 8-bit image data for each channel. Further, the 2-bit pseudo control data PC may be identical for each channel.

The 2-bit pseudo control data PC are transmitted from the timing controller 140 to the source driver integrated circuit 121.

As described above, the 2-bit pseudo control data PC are identical to each other regardless of a channel and thus do not need to be transmitted to each channel.

Therefore, as illustrated in FIG. 7, the source driver integrated circuit 121 including the three channels CH1, CH2, and CH3 receives 3*8-bit image data (RGB data) including 8-bit image data for each of the three channels CH1, CH2, and CH3, but may receive a single 2-bit pseudo control data PC which can be used in common for the three channels CH1, CH2, and CH3.

In this case, the receiving unit 300 of the source driver integrated circuit 121 receives data including a data field RGB DATA Field including 8-bit image data for each channel and a control field CTR Field including 2-bit pseudo control data PC from the timing controller 140.

As described above, the source driver integrated circuit 121 receives 2-bit pseudo control data PC which can be used in common for all channels regardless of the number of channels. That is, the timing controller 140 transmits 2-bit pseudo control data PC which can be used in common for all channels. Therefore, a data transmission amount between the timing controller 140 and the source driver integrated circuit 121 can be greatly reduced.

As described above, the common 2-bit pseudo control data PC is added to the 8-bit image data for each channel. In such case, the accuracy of expressing a color may be limited.

Accordingly, the timing controller 140 generates 2-bit pseudo control data PC in order to accurately express a color.

For example, the timing controller 140 may generate 2-bit pseudo control data PC on the basis of at least one of 10-bit input image data corresponding to each channel, 8-bit image data for each channel, frame information about a frame related to the 8-bit image data for each channel, and row line information about a row line (sub-pixel row) including a sub-pixel to which the 8-bit image data for each channel is supplied.

Accordingly, the 2-bit pseudo control data PC may be changed depending on the 10-bit input image data or the 8-bit image data.

In this case, at the time of digital-analog conversion, the source driver integrated circuit 121 generates 8+2-bit digital data (8-bit image data and 2-bit pseudo control data) identical or very similar to the 10-bit input image data and then performs digital-analog conversion. Therefore, it is possible to more accurately express a color.

Meanwhile, the 2-bit pseudo control data PC may be changed whenever a frame is changed.

For example, the 2-bit pseudo control data PC may be changed every $2^m$ frame cycle.

As a specific example, in the case of m=2, 2-bit pseudo control data PC may be changed every 4-frame cycle as follows.

Pseudo control data PC for each frame in the case of m=2:

00 (PC of Frame 1)⇒01 (PC of Frame 2)⇒10 (PC of Frame 3)⇒11 (PC of Frame 4)⇒00 (PC of Frame 5)⇒01 (PC of Frame 6)⇒10 (PC of Frame 7)⇒11 (PC of Frame 8)⇒ . . . .

As described above, the 2-bit pseudo control data PC are changed depending on a frame. Thus, the 2-bit pseudo control data PC added to the 8-bit image data for each channel reflects well screen characteristics (e.g., brightness characteristics, etc.) of the corresponding frame. Therefore, it is possible to suppress deterioration in image quality even if 10-bit color depth is realized using 8-bit image data.

Meanwhile, the 2-bit pseudo control data PC may be changed whenever a row line is changed.

For example, the 2-bit pseudo control data PC may be changed every $2^m$ row line cycle.

As a specific example, in the case of m=2, 2-bit pseudo control data PC may be changed every 4-row line cycle as follows.

Pseudo control data PC for each frame in the case of m=2:

00 (PC of Row Line 1)⇒01 (PC of Row Line 2)⇒10 (PC of Row Line 3)⇒11 (PC of Row Line 4)⇒00 (PC of Row Line 5)⇒01 (PC of Row Line 6)⇒10 (PC of Row Line 7)⇒11 (PC of Row Line 8)⇒ . . . .

As described above, the 2-bit pseudo control data PC are changed depending on a row line. Thus, the 2-bit pseudo control data PC added to the 8-bit image data for each channel further suitably reflects screen characteristics (e.g., brightness characteristics, etc.) of the corresponding row line. Therefore, it is possible to suppress deterioration in image quality even if 10-bit color depth is realized using 8-bit image data.

Meanwhile, the source driver integrated circuit 121 itself, instead of the timing controller 140, may generate 2-bit pseudo control data PC suitable for a predetermined sequence rule (PC information according to a frame sequence or PC information according to a row line sequence).

Meanwhile, in a method simpler than the above-described methods, the 2-bit pseudo control data PC may be randomly changed among all possible cases.

For example, in the case of m=2, all possible cases of 2-bit pseudo control data PC are four cases (00, 01, 10, and 11). When transmitting 8-bit image data for each channel, the timing controller 140 may transmit one kind of 2-bit pseudo control data PC among the four cases (00, 01, 10, and 11).

In this case, the timing controller 140 can readily generate 2-bit pseudo control data PC.

Meanwhile, the source driver integrated circuit 121 itself, instead of the timing controller 140, may generate 2-bit pseudo control data PC suitable for a predetermined sequence rule.

Figure 8:
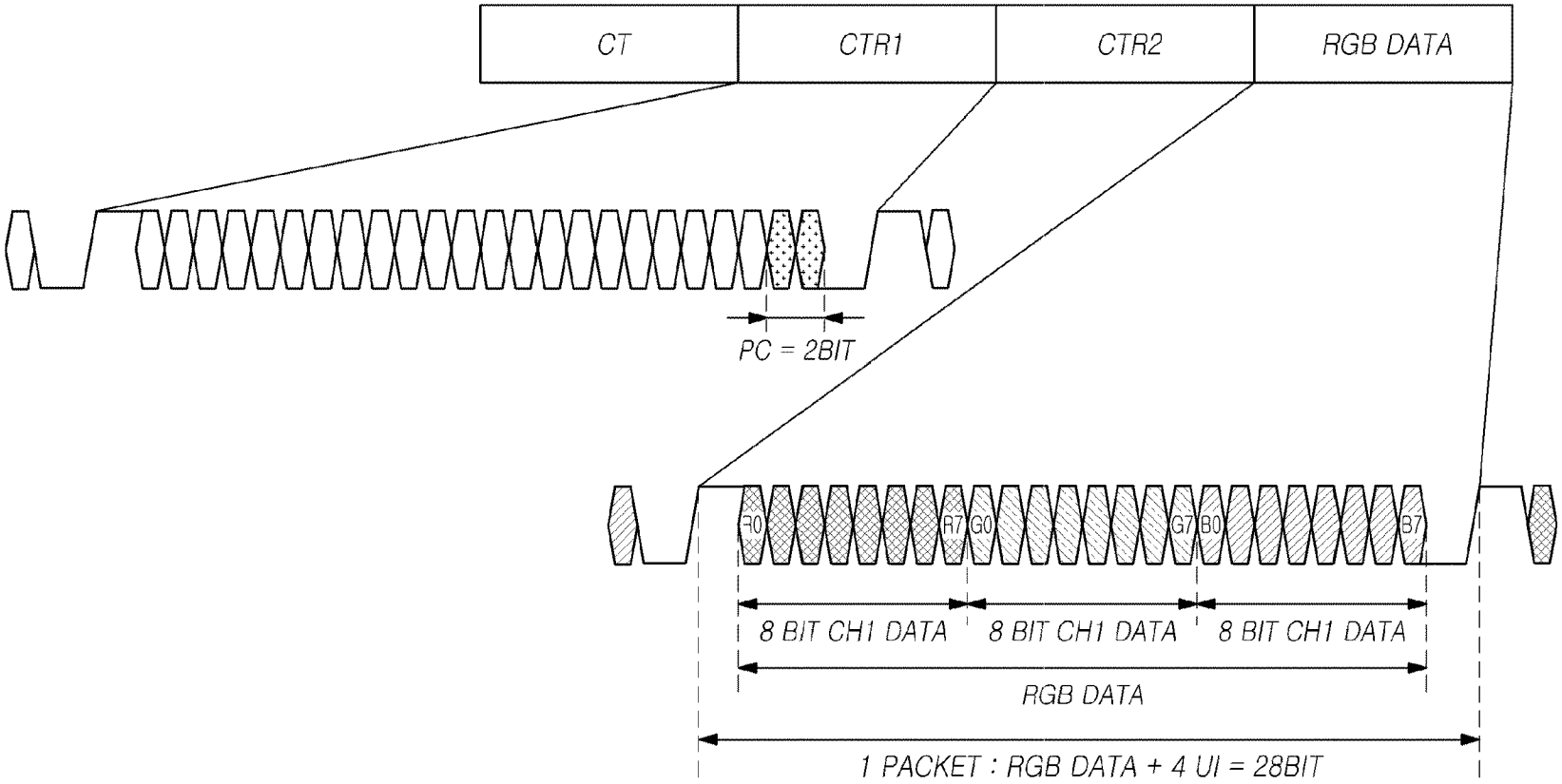
FIG. 8 is an exemplary diagram of a data format used for realizing 10-bit color depth in a source driver integrated circuit according to an embodiment of the present invention and illustrates the data format including 8-bit image data and 2-bit pseudo control data for each channel.

FIG. 8 is an exemplary diagram of a data format used for realizing 10-bit color depth in the source driver integrated circuit 121 according to an embodiment of the present invention and illustrates the data format including 8-bit image data for each channel and 2-bit pseudo control data PC.

In FIG. 8, data transmitted from the timing controller 140 to each source driver integrated circuit 121 include a field CT which indicates starts of control fields CTR1 and CTR2, the control fields CTR1 and CTR2 including various control data, an RGB data field including substantial image data, etc.

Referring to FIG. 8, the RGB data field may include 8-bit image data (e.g., red sub-pixel data) corresponding to CH1, 8-bit image data (e.g., green sub-pixel data) corresponding to CH2, and 8-bit image data (e.g., blue sub-pixel data) corresponding to CH3.

The RGB data field may include, for example, a unit interval (UI) bit corresponding to 4-bit.

Referring to FIG. 8, the control field CTR may include 2-bit pseudo control data PC added in common to each of the 8-bit image data (e.g., red sub-pixel data) corresponding to CH1, the 8-bit image data (e.g., green sub-pixel data) corresponding to CH2, and the 8-bit image data (e.g., blue sub-pixel data) corresponding to CH3.

Figure 9:
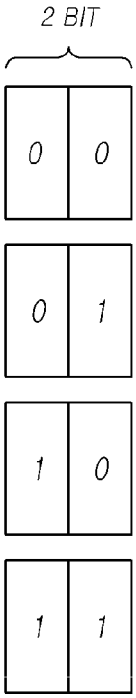
FIG. 9 is a diagram illustrating 2-bit pseudo control data used for realizing 10-bit color depth in a source driver integrated circuit according to an embodiment of the present invention.

FIG. 9 is a diagram illustrating 2-bit pseudo control data PC used for realizing 10-bit color depth in the source driver integrated circuit 121 according to an embodiment of the present invention.

Referring to FIG. 9, if pseudo control data PC are formed of 2-bit, there are a total of $4(=2^2)$ possible cases (00, 01, 10, 11) of the pseudo control data PC.

Figure 10:
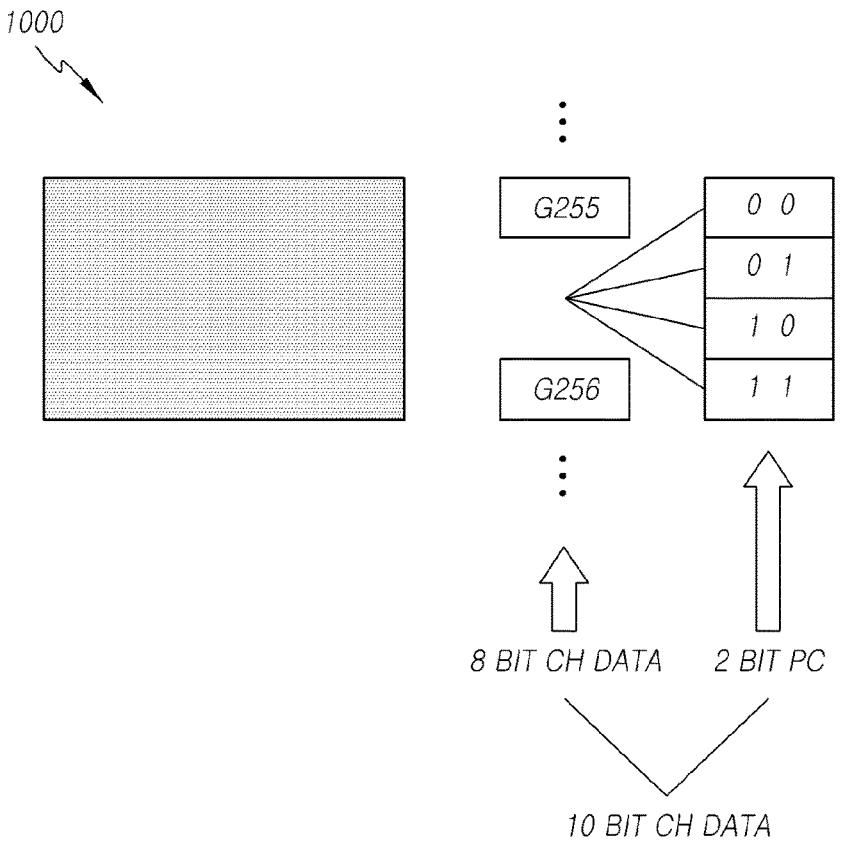
FIG. 10 is an exemplary diagram of 2-bit pseudo control data which are set depending on a solid pattern according to an embodiment of the present invention.

FIG. 10 is an exemplary diagram of 2-bit pseudo control data PC which are set depending on a solid pattern according to an embodiment of the present invention.

Referring to FIG. 10, a whole gray screen 1000 may be expressed using upper 8-bit image (8 bit CH DATA) for each channel and lower 2-bit pseudo control data 2 bit PC. In this case, gray levels can be subdivided into four levels.

Since the lower 2-bit pseudo control data PC are used as one of "00", "01", "10", and "11", a gray level between a gray level G255 and a gray level G256 can be subdivided and expressed.

The lower 2-bit pseudo control data PC added to the upper 8-bit image data for each channel may be set to be identical to each other for each channel.

In this case, the upper 8-bit image data for each channel determines an overall color and the lower 2-bit pseudo control data may be used as information for minutely adjusting brightness.

Herein, the lower 2-bit pseudo control data added to the upper 8-bit image data for each channel may be set to be identical to each other for each channel depending on a solid pattern.

Figure 11:
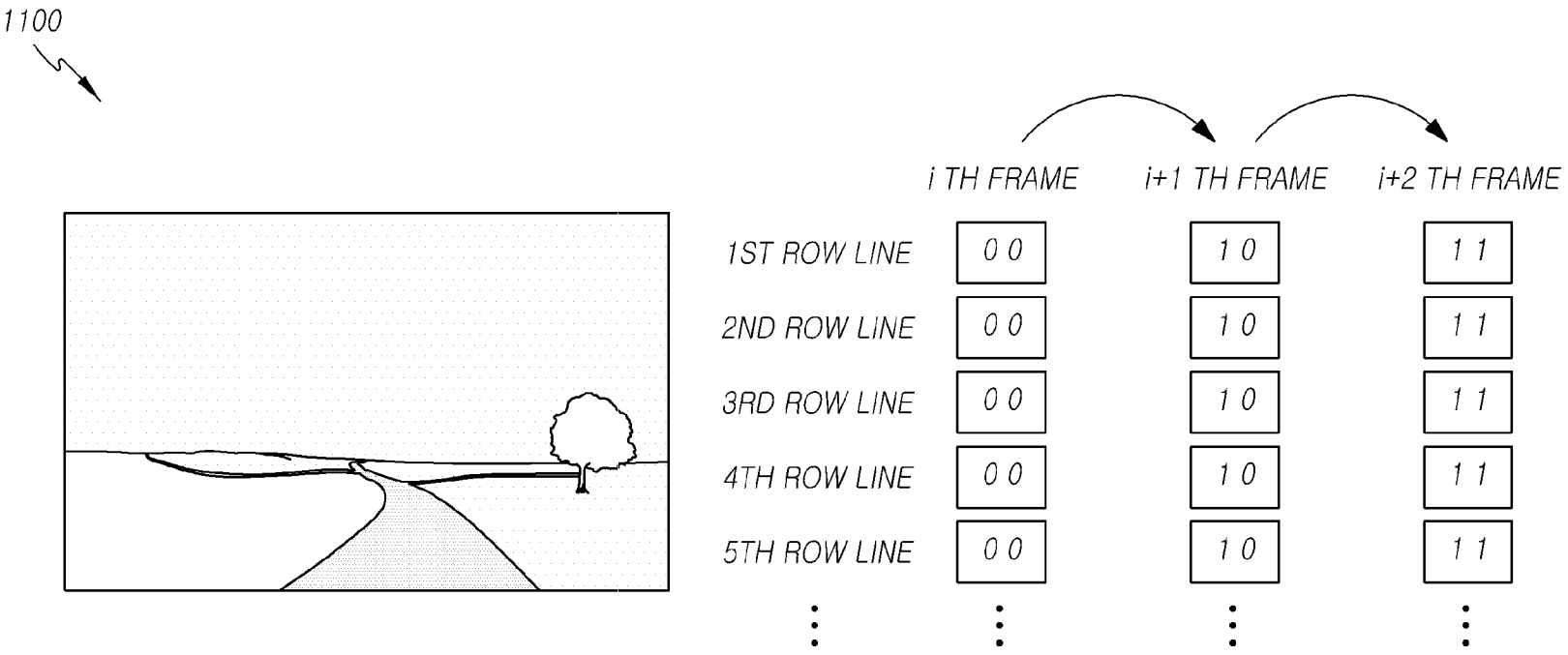
FIG. 11 through FIG. 13 are exemplary diagrams of 2-bit pseudo control data which are set depending on a complex pattern according to an embodiment of the present invention.
Figure 12:
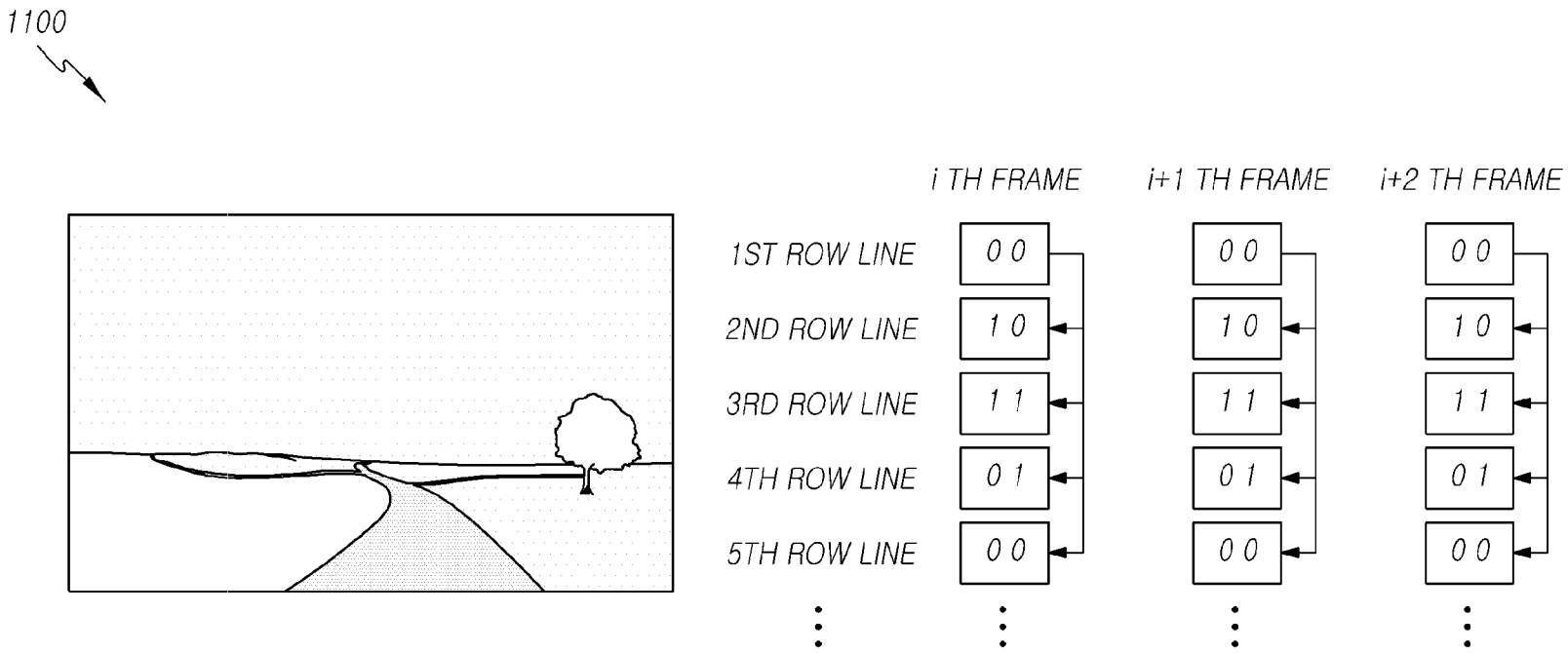
Figure 13:
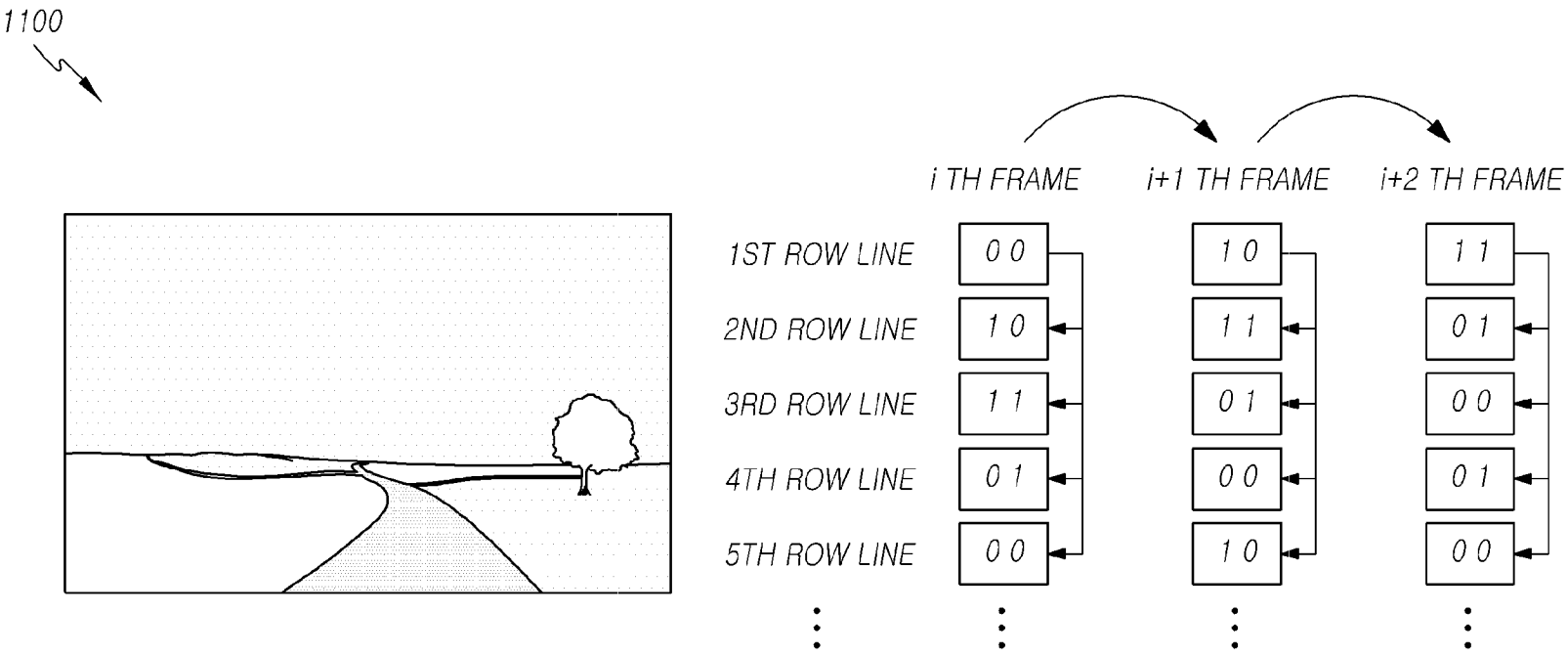

FIG. 11 through FIG. 13 are exemplary diagrams of 2-bit pseudo control data PC which are set depending on a complex pattern according to an embodiment of the present invention.

In the case of a screen 1100 on which various colors are expressed instead of a gray pattern, 2-bit pseudo control data PC may be changed depending on a frame as illustrated in FIG. 11, a row line as illustrated in FIG. 12, or a frame and a row line as illustrated in FIG. 13.

If 2-bit is used as pseudo control data PC, a variable cycle may be $2^m$.

Figure 14:
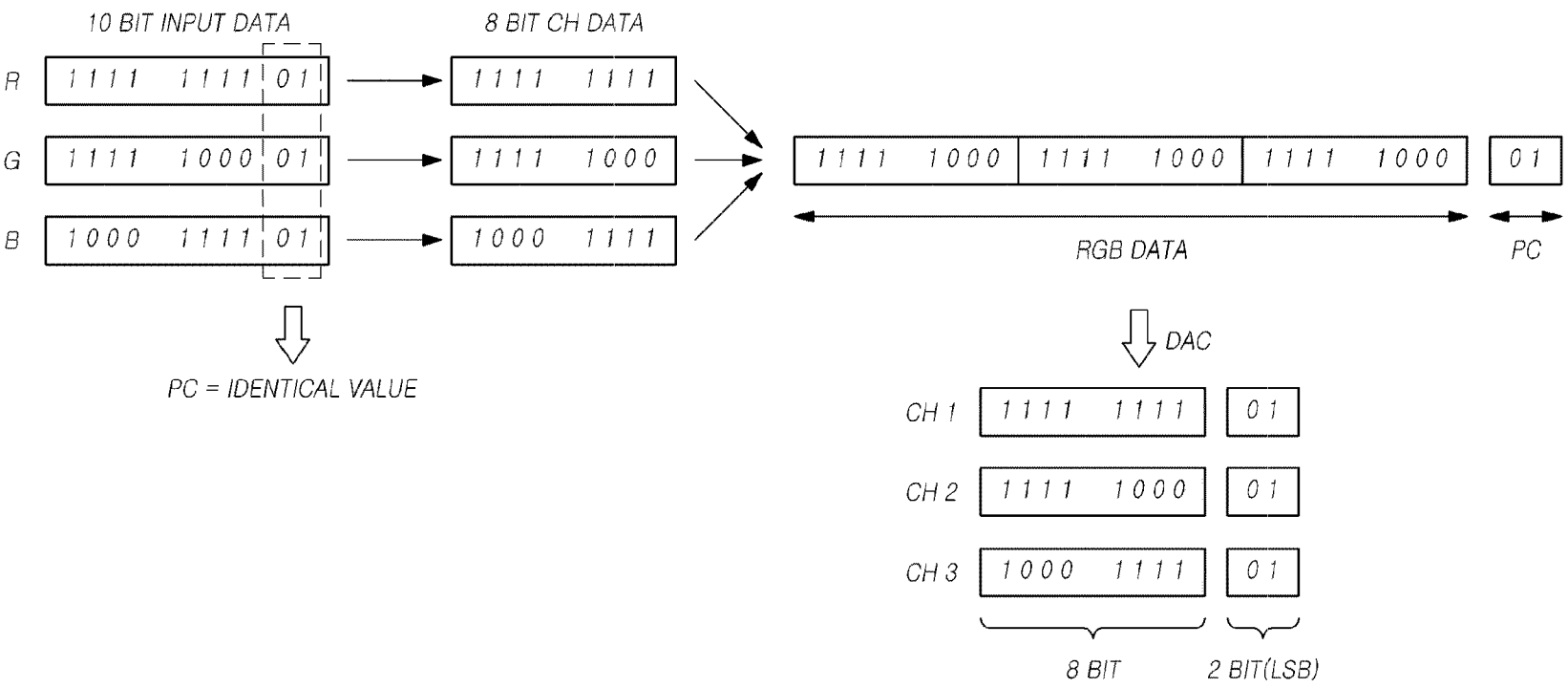
FIG. 14 through FIG. 16 are exemplary diagrams illustrating that a timing controller according to an embodiment of the present invention sets 2-bit pseudo control data on the basis of input image data.
Figure 15:
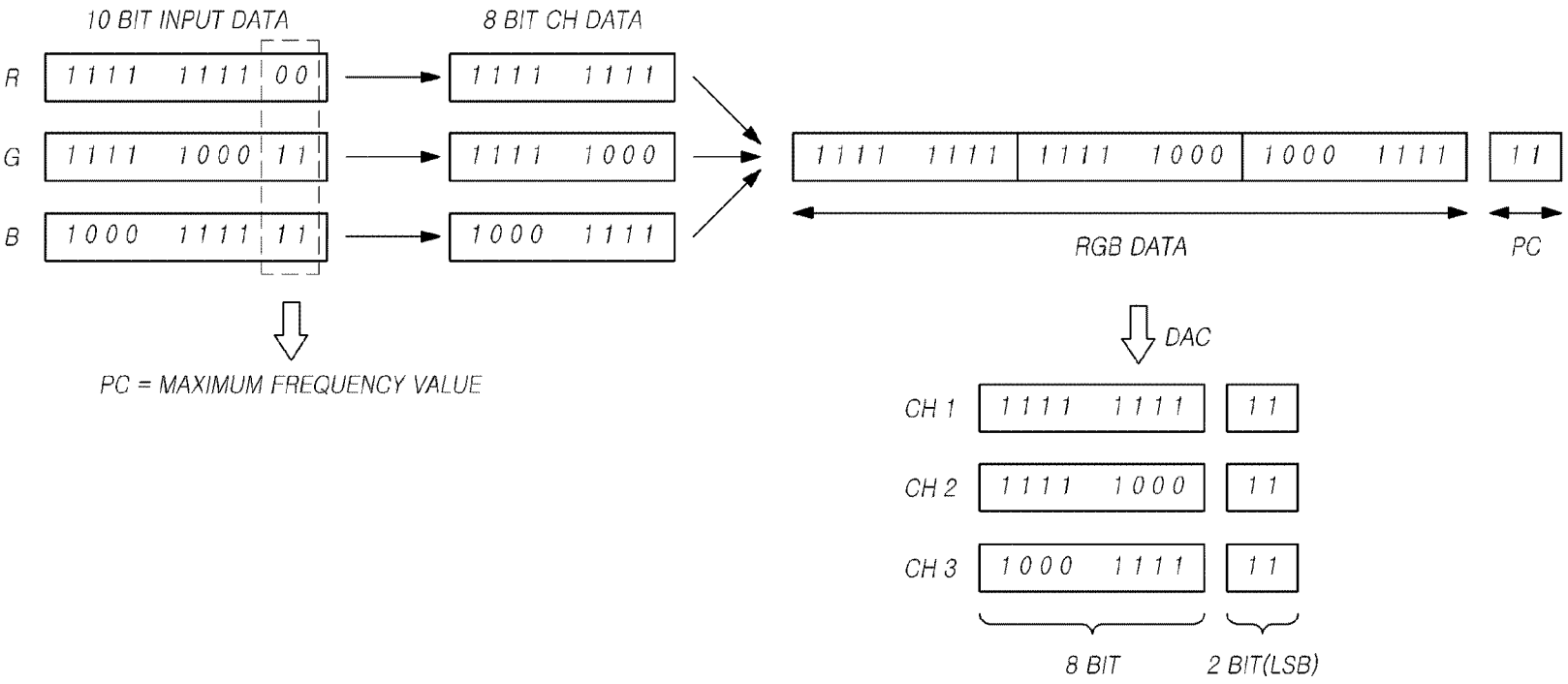
Figure 16:
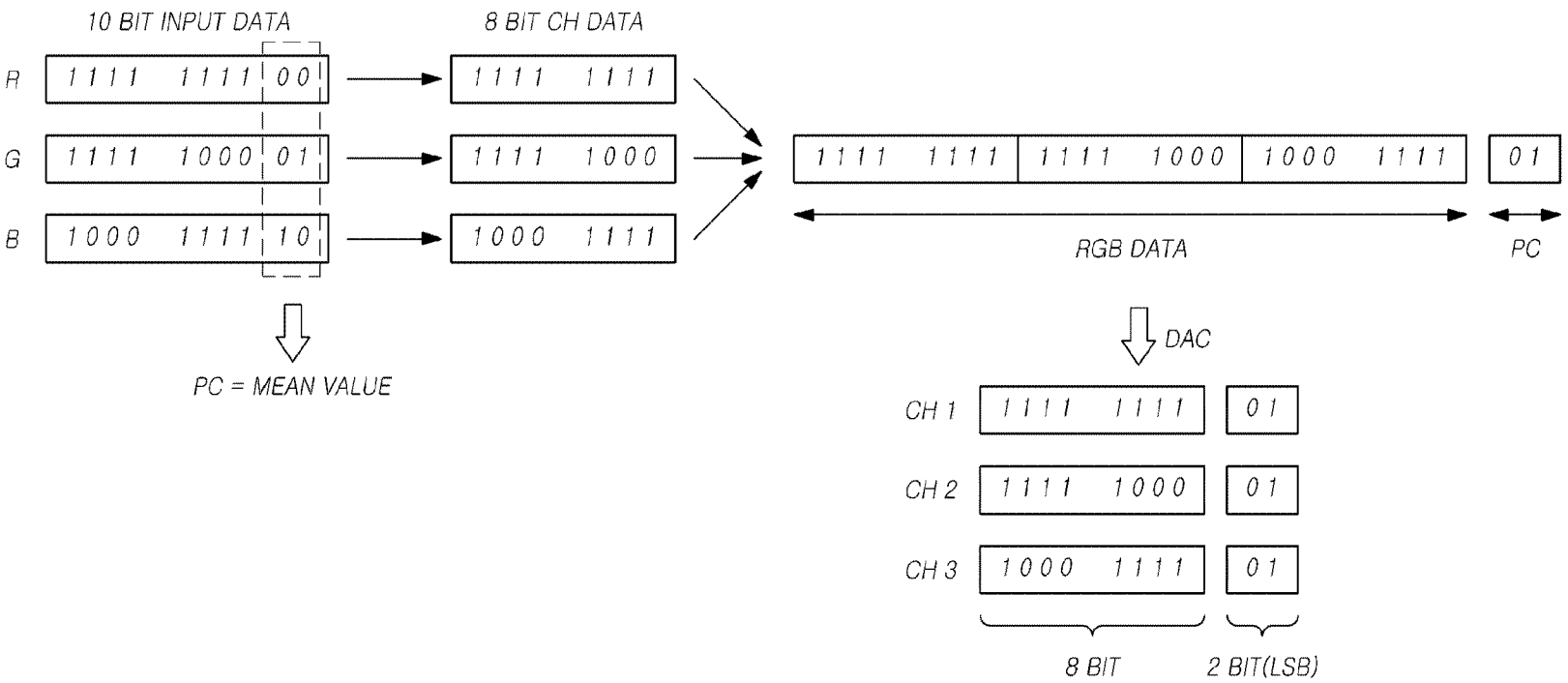

FIG. 14 through FIG. 16 are exemplary diagrams illustrating that the timing controller 140 according to an embodiment of the present invention sets 2-bit pseudo control data PC on the basis of input image data.

Referring to FIG. 14, if 10 (N=10)-bit input image data corresponding to a red sub-pixel are "1111 1111 01", 10-bit input image data corresponding to a green sub-pixel are "1111 1000 01", and 10-bit input image data corresponding to a blue sub-pixel are "1000 1111 01", 8 (n=8)-bit image data 8 bit CH DATA (8 bit CH DATA) for the respective channels transmitted from the timing controller 140 to the source driver integrated circuit 121 are "1111 1111", "1111 1000", and "1000 1111".

Referring to FIG. 14, lower 2-bits from the 10-bit input image data corresponding to the red sub-pixel, the 10-bit input image data corresponding to the green sub-pixel, and the 10-bit input image data corresponding to the blue sub-pixel are identically "01".

In this case, the identical lower 2-bit stream (01) may be set as pseudo control data PC.

Therefore, data transmitted from the timing controller 140 to the source driver integrated circuit 121 may include RGB data (1111 1111 1111 1000 1000 1111) including the 8-bit image data (1111 1111) for CH1 corresponding to the red sub-pixel, the 8-bit image data (1111 1000) for CH1 corresponding to the green sub-pixel and the 8-bit image data (1000 1111) for CH1 corresponding to the blue sub-pixel, and the 2-bit pseudo control data (01).

Referring to FIG. 14, the source driver integrated circuit 121 performs digital-analog conversion to the data received from the timing controller 140 and outputs a data voltage to each of the three channels CH1, CH2, and CH3.

Herein, the digital-analog converter 430*r* corresponding to CH1 configured to output a data voltage to the red sub-pixel converts 10-bit digital data including the 2-bit pseudo control data (01) combined as least significant bits with the 8-bit image data (1111 1111) for CH1 corresponding to the red sub-pixel into an analog voltage.

The digital-analog converter 430*g* corresponding to CH2 configured to output a data voltage to the green sub-pixel converts 10-bit digital data including the 2-bit pseudo control data (01) combined as least significant bits with the 8-bit image data (1111 1000) for CH2 corresponding to the green sub-pixel into an analog voltage.

The digital-analog converter 430*b* corresponding to CH3 configured to output a data voltage to the blue sub-pixel converts 10-bit digital data including the 2-bit pseudo control data (01) combined as least significant bits with the 8-bit image data (1000 1111) for CH3 corresponding to the blue sub-pixel into an analog voltage.

Referring to FIG. 15, if 10-bit input image data corresponding to a red sub-pixel are "1111 1111 00", 10-bit input image data corresponding to a green sub-pixel are "1111 1000 11", and 10-bit input image data corresponding to a blue sub-pixel are "1000 1111 11", 8 (n=8)-bit image data 8 bit CH DATA for the respective channels transmitted from the timing controller 140 to the source driver integrated circuit 121 are "1111 1111", "1111 1000", and "1000 1111".

Referring to FIG. 15, lower 2-bits from the 10-bit input image data corresponding to the red sub-pixel, the 10-bit input image data corresponding to the green sub-pixel, and the 10-bit input image data corresponding to the blue sub-pixel are "00", "11", and "11", respectively, which are different from each other.

In this case, the lower 2-bit stream (11) having a maximum frequency value among the three lower 2-bits (00, 11, and 11) may be set as pseudo control data PC.

That is, "11" among the three lower 2-bits (00, 11, and 11) has the maximum frequency value (2 times). Therefore, "11" may be set as 2-bit pseudo control data PC.

Therefore, data transmitted from the timing controller 140 to the source driver integrated circuit 121 may include RGB data (1111 1111 1111 1000 1000 1111) including the 8-bit image data (1111 1111) for CH1 corresponding to the red sub-pixel, the 8-bit image data (1111 1000) for CH1 corresponding to the green sub-pixel and the 8-bit image data (1000 1111) for CH1 corresponding to the blue sub-pixel, and the 2-bit pseudo control data (11).

Referring to FIG. 15, the source driver integrated circuit 121 performs digital-analog conversion to the data received from the timing controller 140 and outputs a data voltage to each of the three channels CH1, CH2, and CH3.

Herein, the digital-analog converter 430*r* corresponding to CH1 configured to output a data voltage to the red sub-pixel converts 10-bit digital data including the 2-bit pseudo control data (11) combined as least significant bits with the 8-bit image data (1111 1111) for CH1 corresponding to the red sub-pixel into an analog voltage.

The digital-analog converter 430*g* corresponding to CH2 configured to output a data voltage to the green sub-pixel converts 10-bit digital data including the 2-bit pseudo control data (11) combined as least significant bits with the 8-bit image data (1111 1000) for CH2 corresponding to the green sub-pixel into an analog voltage.

The digital-analog converter 430*b* corresponding to CH3 configured to output a data voltage to the blue sub-pixel converts 10-bit digital data including the 2-bit pseudo control data (11) combined as least significant bits with the 8-bit image data (1000 1111) for CH3 corresponding to the blue sub-pixel into an analog voltage.

Referring to FIG. 16, if 10-bit input image data corresponding to a red sub-pixel are "1111 1111 00", 10-bit input image data corresponding to a green sub-pixel are "1111 1000 01", and 10-bit input image data corresponding to a blue sub-pixel are "1000 1111 10", 8 (n=8)-bit image data 8 bit CH DATA for the respective channels transmitted from the timing controller 140 to the source driver integrated circuit 121 are "1111 1111", "1111 1000", and "1000 1111".

Referring to FIG. 16, lower 2-bits from the 10-bit input image data corresponding to the red sub-pixel, the 10-bit input image data corresponding to the green sub-pixel, and the 10-bit input image data corresponding to the blue sub-pixel are "00", "01", and "10", respectively, which are different from each other.

In this case, a mean value (01) of the three lower 2-bits (00, 01, and 10) may be set as 2-bit pseudo control data PC.

The three lower 2-bits (00, 01, and 10) can be expressed as decimal numbers: 0, 1, and 2, respectively. Therefore, a decimal numbers mean value of the three lower 2-bits (00, 01, and 10) is 1 (=(0+1+2)/3), which can be expressed as a binary number "01".

Therefore, data transmitted from the timing controller 140 to the source driver integrated circuit 121 may include RGB data (1111 1111 1111 1000 1000 1111) including the 8-bit image data (1111 1111) for CH1 corresponding to the red sub-pixel, the 8-bit image data (1111 1000) for CH1 corresponding to the green sub-pixel and the 8-bit image data (1000 1111) for CH1 corresponding to the blue sub-pixel, and the 2-bit pseudo control data (01).

Referring to FIG. 16, the source driver integrated circuit 121 performs digital-analog conversion to the data received from the timing controller 140 and outputs a data voltage to each of the three channels CH1, CH2, and CH3.

Herein, the digital-analog converter 430*r* corresponding to CH1 configured to output a data voltage to the red sub-pixel converts 10-bit digital data including the 2-bit pseudo control data (01) combined as least significant bits with the 8-bit image data (1111 1111) for CH1 corresponding to the red sub-pixel into an analog voltage.

The digital-analog converter 430*g* corresponding to CH2 configured to output a data voltage to the green sub-pixel converts 10-bit digital data including the 2-bit pseudo control data (01) combined as least significant bits with the 8-bit image data (1111 1000) for CH2 corresponding to the green sub-pixel into an analog voltage.

The digital-analog converter 430*b* corresponding to CH3 configured to output a data voltage to the blue sub-pixel converts 10-bit digital data including the 2-bit pseudo control data (01) combined as least significant bits with the 8-bit image data (1000 1111) for CH3 corresponding to the blue sub-pixel into an analog voltage.

Figure 17:
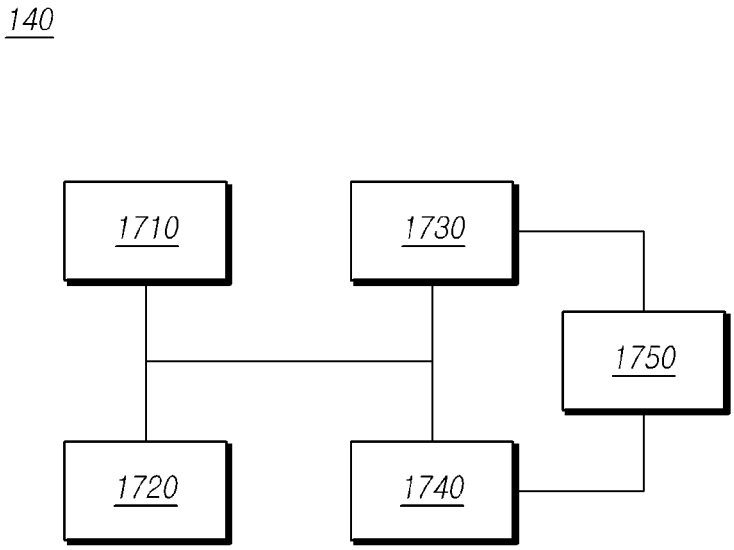
FIG. 17 is a block diagram of a timing controller according to an embodiment of the present invention.

FIG. 17 is a block diagram of the timing controller 140 according to an embodiment of the present invention.

Referring to FIG. 17, the timing controller 140 according to an embodiment of the present invention includes: a receiving unit 1710 configured to receive input image data of higher than n-bit, i.e., N-bit input image data (N=n+m), for each sub-pixel from the host system 10; a storage unit 1720 configured to store the N-bit input image data (N=n+m) for each sub-pixel; an extraction unit 1730 configured to extract n-bit image data to be transmitted to the source driver integrated circuit 121 within the data driver 120 from the input image data of higher than n-bit, i.e., N-bit input image data, for each sub-pixel; a pseudo control data generation unit 1740 configured to generate pseudo control data of m-bit corresponding to a bit number obtained by subtracting n-bit from N-bit; and a transmission unit 1750 configured to transmit data including the n-bit image data extracted for each sub-pixel and the generated m-bit pseudo control data to the source driver integrated circuit 121 within the data driver 120.

Herein, N as a bit number corresponding to color depth, n as a transmission bit number of image data, and m as a bit number of pseudo control data are predetermined values.

Further, N as a bit number corresponding to color depth is the sum of n as a transmission bit number of image data and m as a bit number of pseudo control data.

An interface between the timing controller 140 and the source driver integrated circuit 121 may be EPI, or may be another interface such as a low voltage differential signaling (LVDS) interface in some cases.

The display device 100 extracts n-bit image data from input image data of higher than n-bit.

As described above, the timing controller 140 extracts n-bit image data from N-bit input image data and transmits the n-bit image data to the data driver 120. Thus, a data transmission amount between the timing controller 140 and the source driver integrated circuit 121 can be greatly reduced.

Meanwhile, the pseudo control data generation unit 1740 of the timing controller 140 may generate m-bit pseudo control data on the basis of input image data of higher than n-bit, generate m-bit pseudo control data on the basis of n-bit image data, or generate m-bit pseudo control data on the basis of input image data remaining after extracting n-bit image data from input image data of higher than n-bit.

Accordingly, it is possible to reduce a data transmission amount by N-n-bit for each sub-pixel, and also possible to perform analog conversion to N-bit digital data (n-bit image data+m-bit pseudo control data) identical or almost identical to original N-bit input image data at the time of digital-analog conversion of the data driver 120. Therefore, it is possible to express an N-bit color which is nearly identical to a real color.

Meanwhile, the pseudo control data generation unit 1740 of the timing controller 140 may generate m-bit pseudo control data PC on the basis of frame information (e.g., frame identification information, etc.) corresponding to input image data of higher than n-bit, i.e., N-bit input image data.

As described above, since the m-bit pseudo control data PC are generated on the basis of the frame information, the m-bit pseudo control data PC to be added to n-bit image data for each channel may suitably reflect screen characteristics (e.g., color characteristics, brightness characteristics, gray level characteristics, etc.) of the corresponding frame. Therefore, it is possible to supply a high-quality image while realizing N-bit color depth using image data of n-bit having a lower bit number than N-bit corresponding to a desired color depth.

Meanwhile, the pseudo control data generation unit 1740 of the timing controller 140 generate m-bit pseudo control data PC on the basis of row line information corresponding to input image data of higher than n-bit, i.e., N-bit input image data.

As described above, since the m-bit pseudo control data PC are generated on the basis of the row line information (or sub-pixel row information or gate line information), the m-bit pseudo control data PC to be added to n-bit image data for each channel may suitably reflect screen characteristics (e.g., color characteristics, brightness characteristics, gray level characteristics, etc.) of the corresponding row line. Therefore, it is possible to supply a high-quality image while realizing N-bit color depth using image data of n-bit having a lower bit number than N-bit corresponding to a desired color depth.

The above-described data driving method of the source driver integrated circuit 121 within the data driver 120 according to an embodiment of the present invention will be briefly described again with reference to FIG. 18.

Figure 18:
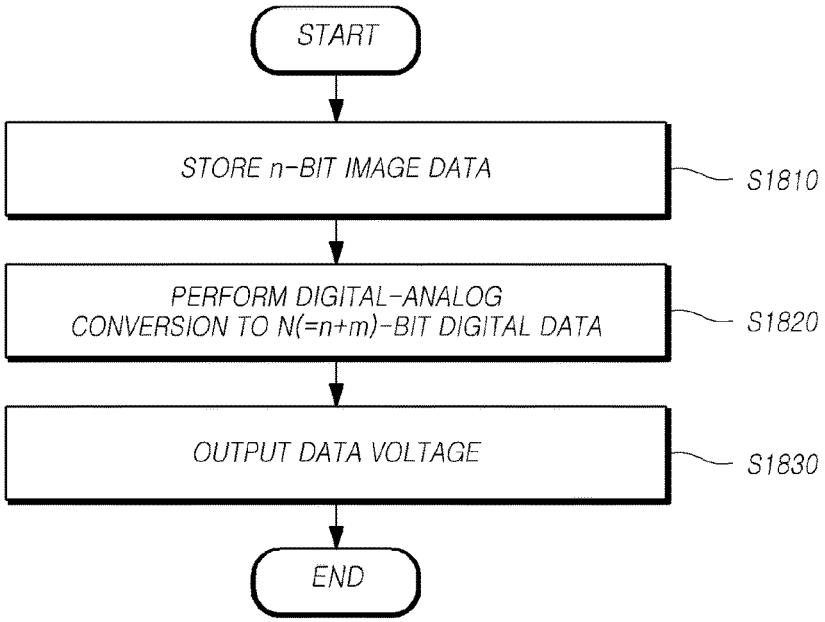
FIG. 18 is a flowchart illustrating a data driving method according to an embodiment of the present invention.

FIG. 18 is a flowchart illustrating a data driving method according to an embodiment of the present invention.

Referring to FIG. 18, the data driving method of the data driver 120 according to an embodiment of the present invention may include: storing n-bit image data (S1810); converting m+n-bit digital data including n-bit image data and variable m-bit pseudo control data into an analog voltage (S1820); and outputting a data voltage on the basis of the analog voltage (S1830).

If the above-described data driving method is used, it is possible to realize N-bit color depth using n-bit image data having a lower bit number than N-bit corresponding to color depth desired to be realized.

Therefore, a data transmission amount between the timing controller 140 and the data driver 120 can be reduced.

Further, a latch and a level shifter for each channel in the source driver integrated circuit 121 within the data driver 120 can be designed as n-bit components having a lower bit number than N-bit corresponding to color depth desired to be realized. Thus, a size of the source driver integrated circuit 121 can be greatly reduced.

Figure 19:
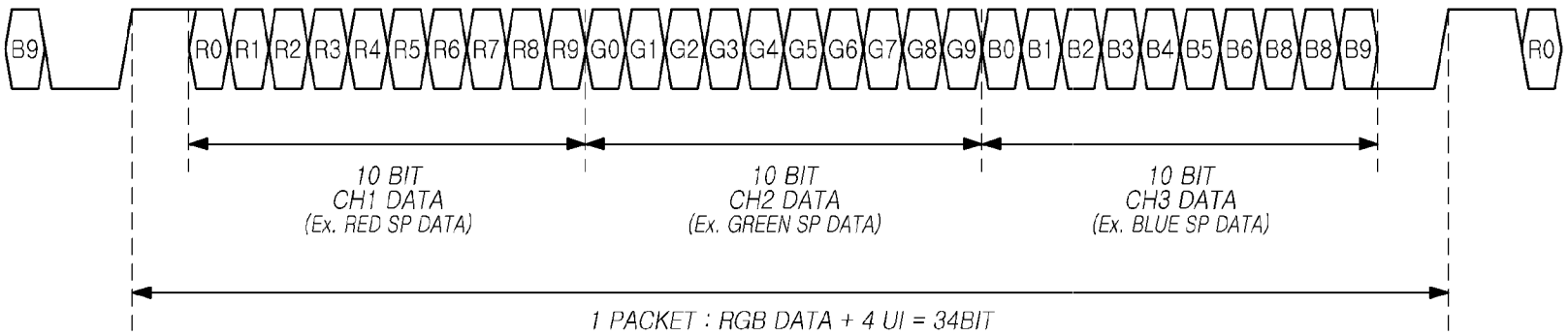
FIG. 19 and FIG. 20 are other example diagrams of a data format used for realizing 10-bit color depth.
Figure 20:
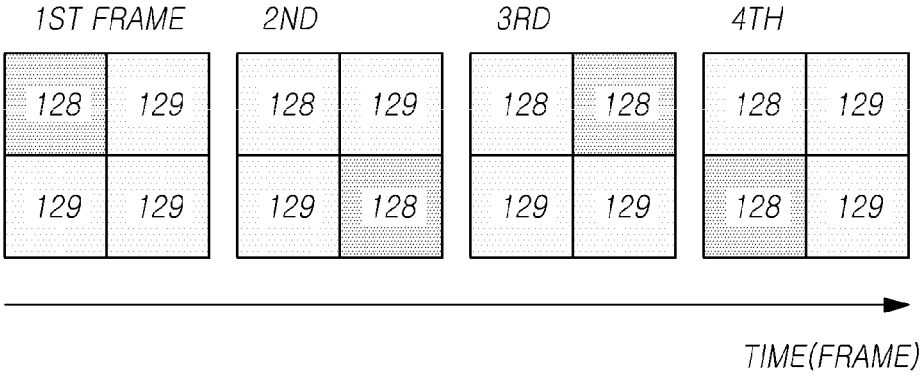

FIG. 19 and FIG. 20 are diagrams provided to explain other methods for realizing 10-bit color depth.

Referring to FIG. 19, as one of methods for realizing 10-bit color depth, there is a real 10-bit color depth realization method in which the timing controller 140 transmits 10-bit image data and all the components (latch, level shifter, DAC, output buffer, etc.) within the source driver integrated circuit 121 are designed as 10-bit components.

In this case, there is a problem of an increase in data transmission amount between the timing controller 140 and the data driver 120.

Assuming that there are three channels, if the real 10-bit color depth realization method is used, the amount of transmitted RGB data is increased by 6-bit (=3*10−3*8) as compared with a case where 2-bit pseudo control data and 8-bit image data are used.

Further, if 2-bit pseudo control data are additionally used, a data transmission amount is increased by 4-bit (=6−2).

That is, the 10-bit color depth realization method according to an embodiment of the present invention has an effect of reducing a data transmission amount as compared with the real 10-bit color depth realization method.

This effect may be further increased as the number of channels in the source driver integrated circuit 121 is increased.

Further, in the case of the 10-bit color depth realization method according to an embodiment of the present invention, the source driver integrated circuit 121 may be implemented with an 8-bit latch and an 8-bit level shifter for each channel. Therefore, the 10-bit color depth realization method according to an embodiment of the present invention has an effect of greatly reducing a size of the source driver integrated circuit 121 as compared with the real 10-bit color depth realization method using a 10-bit source driver integrated circuit 121 in which all the components are designed as 10-bit components.

Referring to FIG. 20, there is another 10-bit color depth realization method using an 8-bit source driver integrated circuit 121 and dithering.

The 10-bit color depth realization method using dithering may be implemented with the 8-bit source driver integrated circuit 121 in which all the components (latch, level shifter, DAC, output buffer, etc.) are designed as 8-bit components. Therefore, a size and cost of the source driver integrated circuit 121 can be reduced. However, this method has a problem of deterioration in image quality as compared with the 10-bit color depth realization method according to an embodiment of the present invention and the real 10-bit color depth realization method.

According to the above descriptions, if N as a bit number corresponding to color depth is 10, the 10-bit color depth realization method according to an embodiment of the present invention can greatly reduce a size and cost of the source driver integrated circuit 121 as compared with the real 10-bit color depth realization method.

In this regard, the source driver integrated circuit 121 providing the 10-bit color depth realization method according to an embodiment of the present invention has an advantage of being able to use a digital block of an 8-bit source driver integrated circuit as it is.

Further, the 10-bit color depth realization method according to an embodiment of the present invention can supply a higher image quality than the 10-bit color depth realization method using dithering.

The 10-bit color depth realization method according to an embodiment of the present invention may supply an image quality equivalent or similar to that of the real 10-bit color depth realization method depending on a pseudo control data generation method.

According to the embodiments of the present invention described above, it is possible to provide the data driver 120 and the driving method of the data driver capable of supplying a high image quality with a small size.

According to the embodiments of the present invention, it is possible to provide the data driver 120, the display device 100, and the data driving method capable of supplying a high image quality and reducing a data transmission amount.

According to the embodiments of the present invention, it is possible to provide the data driver 120, the display device 100, and the data driving method capable of realizing color depth of N-bit having a higher bit number than n-bit using n-bit image data.

According to the embodiments of the present invention, it is possible to provide the data driver 120, the display device 100, and the data driving method capable of realizing color depth of N-bit having a higher bit number than n-bit using n-bit image data while supplying an excellent image quality.

According to the embodiments of the present invention, it is possible to provide the data driver 120 capable of realizing desired color depth of N-bit with a small size.

The foregoing description and the accompanying drawings are provided only to illustrate the technical conception of the present invention, but it will be understood by a person having ordinary skill in the art that various modifications and changes such as combinations, separations, substitutions, and alterations of the components may be made without departing from the scope of the present invention. Therefore, the example embodiments of the present invention are provided for illustrative purposes only but not intended to limit the technical concept of the present invention. The scope of the technical concept of the present invention is not limited thereto. The protective scope of the present invention should be construed based on the following claims, and all the technical concepts in the equivalent scope thereof should be construed as falling within the scope of the present invention.

What is claimed is:

1. A data driver comprising:

a receiver configured to receive, from a timing controller, p-bit image data for each of a plurality of channels each corresponding to a sub-pixel, wherein p is a positive integer;

a plurality of p-bit latches each configured to store the p-bit image data of a corresponding channel among the plurality of channels, wherein $p \geq 2$ and $p < N$; and a plurality of convertors configured to add variable m-bit pseudo control data to the p-bit image data of the corresponding channel among the plurality of channels to generate resultant N-bit digital image data and convert the resultant N-bit digital image data into an analog voltage and then output the analog voltage, wherein $m \geq 1$ and N is a positive integer, wherein the p-bit digital image data for each channel among the plurality of channels is specific to the corresponding channel, wherein the variable m-bit pseudo control data is common to each of the plurality of channels, and wherein the variable m-bit pseudo control data is generated based on: i) at least part of original N-bit digital input image data of the corresponding channel, ii) information about a corresponding frame, or iii) information about a corresponding sub-pixel row.

2. The data driver of claim 1, wherein the variable m-bit pseudo control data added to the p-bit image data for each channel among the plurality of channels are identical to each other.

3. The data driver of claim 1, wherein the data driver changes the variable m-bit pseudo control data depending on the p-bit image data, or input image data from the original N-bit input image data that includes a more significant bit than p-bit including the p-bit image data, or other data in the original N-bit digital input image different than the p-bit image data.

4. The data driver of claim 1, wherein the data driver changes the m-bit pseudo control data whenever a frame is changed.

5. The data driver of claim 1, wherein the data driver changes the m-bit pseudo control data every $2^m$ frame cycle.

6. The data driver of claim 1, wherein the data driver changes the m-bit pseudo control data whenever a row line is changed.

7. The data driver of claim 1, wherein the data driver changes the m-bit pseudo control data every $2^m$ row line cycle.

8. The data driver of claim 1, wherein the data driver randomly changes the m-bit pseudo control data.

9. The data driver of claim 1, wherein the convertor includes an N-bit digital-analog converter for each channel, and the data driver further includes a p-bit level shifter between each of the plurality of p-bit latches the n bit latch and the N-bit digital-analog converter for each channel among the plurality of channels.

10. A data driving method of a data driver, the method comprising:

receiving, from a timing controller, p-bit image data for each of a plurality of channels each corresponding to a sub-pixel, wherein p is a positive integer;

storing, via a p-bit latch, the p-bit image data of a corresponding channel among the plurality of channels, wherein $p \geq 2$; and adding variable m-bit pseudo control data to the p-bit image data of the corresponding channel among the plurality of channels to generate resultant N-bit digital image data and converting the resultant N-bit digital image data into an analog voltage and then outputting the analog voltage, wherein $m \geq 1$ N is a positive integer, and $p<N$, wherein the p-bit digital image data for each channel among the plurality of channels is specific to the corresponding channel, wherein the variable m-bit pseudo control data is common to each of the plurality of channels, and wherein the variable m-bit pseudo control data is generated based on: i) at least part of original N-bit digital input data of the corresponding channel, ii) information about a corresponding frame, or iii) information about a corresponding sub-pixel row.

* * * * *